US006808852B2

(12) United States Patent
Hotta et al.

(10) Patent No.: US 6,808,852 B2
(45) Date of Patent: Oct. 26, 2004

(54) TONER AND HEAT-FIXING METHOD

(75) Inventors: Yojiro Hotta, Abiko (JP); Wakashi Iida, Toride (JP); Tetsuya Ida, Mishima (JP); Takayuki Itakura, Mishima (JP); Nozomu Komatsu, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 10/233,417

(22) Filed: Sep. 4, 2002

(65) Prior Publication Data

US 2003/0129517 A1 Jul. 10, 2003

(30) Foreign Application Priority Data

Sep. 6, 2001 (JP) ..... 2001-270065

(51) Int. Cl.[7] ..... G03G 9/00

(52) U.S. Cl. ..... 430/108.22; 430/109.4; 430/108.3; 430/109.3; 430/109.31

(58) Field of Search ..... 430/108.22, 109.4, 430/108.3, 109.3, 109.31

(56) References Cited

U.S. PATENT DOCUMENTS

| | | | | |
|---|---|---|---|---|
| 2,297,691 | A | 10/1942 | Carlson | |
| 3,941,898 | A | 3/1976 | Sadamatsu et al. | 427/18 |
| 4,071,361 | A | 1/1978 | Marushima | 96/1.4 |
| 4,499,168 | A | 2/1985 | Mitsuhashi | 430/99 |
| 4,578,338 | A | 3/1986 | Gruber et al. | 430/120 |
| 4,810,612 | A | 3/1989 | Ueda et al. | 430/109 |
| 4,921,771 | A | 5/1990 | Tomono et al. | 430/110 |
| 4,968,574 | A | 11/1990 | Morita et al. | 430/109 |

FOREIGN PATENT DOCUMENTS

| | | |
|---|---|---|
| EP | 0421416 | 4/1991 |
| EP | 0435692 | 7/1991 |
| EP | 0774695 | 5/1997 |
| EP | 0898204 | 2/1999 |
| JP | 51-23354 | 7/1976 |
| JP | 52-3304 | 1/1977 |
| JP | 52-3305 | 1/1977 |
| JP | 55-6805 | 2/1980 |

OTHER PUBLICATIONS

Database WPI, Section Ch, Week 198527, Derwent Publications, Class A04, An–1985–162564, XP–002268993 for JP 60–93456, 1985.

*Primary Examiner*—Mark A. Chapman
(74) *Attorney, Agent, or Firm*—Fitzpatrick, Cella, Harper & Scinto

(57) ABSTRACT

A toner characterized by improved fixing performances with no or minimum oil application is formed of: (i) a binder resin, (ii) a colorant, (iii) a hydrocarbon wax, (iv) a resin composition formed by copolymerization of a styrenic monomer together with at least one of nitrogen-containing vinyl monomers, carboxyl group-containing monomers, hydroxyl group-containing monomers and (meth)acrylate ester monomers, in the presence of a hydrocarbon unit; and (v) an organometallic compound. The binder resin (i) comprises a polyester component in a proportion of at least 60 wt. % of the binder resin. The toner has a GPC molecular weight distribution including a weight-average molecular weight (Mw) of at least $4.0\times10^4$ an a ratio Mw/Mn of at least 50 between the Mw and a number-average molecular weight (Mn).

23 Claims, 7 Drawing Sheets

TONER AND HEAT-FIXING METHOD

FIELD OF THE INVENTION AND RELATED ART

The present invention relates to a toner used for developing electrostatic images in image forming methods, such as electrophotography and electrostatic printing, particularly a toner suited for heat-pressure fixation, and further a heat-fixing method using such a toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

As for the step of fixing the toner image onto a sheet (transfer) material such as paper which is the final step in the above-mentioned electrophotographic process, various methods and apparatus have been developed, of which the most popular one is a heating and pressing fixation system using hot rollers.

In the heating and pressing system using hot rollers, a transfer(-receiving) material, such as paper, carrying a toner image to be fixed is passed through hot rollers, while a surface of a hot roller having a releasability with the toner is caused to contact the toner image surface of the transfer material under pressure, to fix the toner image. In this method, as the hot roller surface and the toner image on the transfer material contact each other under a pressure, a very good heat efficiency is attained for melt-fixing the toner image onto the transfer material to afford quick fixation.

In the fixing step, however, a hot roller surface and a toner image contact each other in a softened or melted state and under a pressure, so that a part of the toner is transferred and attached to the fixing roller surface and then re-transferred to a subsequent transfer material to soil the transfer material. This is called an offset phenomenon. Accordingly, the prevention of a toner from being attached onto a hot fixing roller surface is considered as an important condition to be satisfied in the hot-roller fixing scheme.

Hitherto, for the purpose of preventing toner attachment onto a fixing roller surface, it has been practiced, for example, to form the roller surface of a material (e.g., silicone rubber or fluorine-containing resin) showing excellent releasability with respect to the toner and further coat the roller surface with a liquid showing good releasability, such as silicone oil, for the purpose of offset prevention and for preventing the fatigue of the roller surface material. However, while this is very effective form the viewpoint of toner offset prevention, this method is accompanied with the problem of resulting in a complicated fixing apparatus because of the necessity of a mechanism for supplying such an offset preventing liquid.

On the other hand, as transfer material for toner image fixation thereon, there have been generally used various grades of papers, coated papers and plastic films. Particularly, there is an increasing need for a transparency film for OHP (overhead projectors) (hereinafter called an "OHP film") as a means for presentation in various meetings or congress. Unlike papers, such an OHP film shows only a low oil absorptivity, so that in the case of using an offset-preventing oil, such as silicone liquid, a substantial amount oil is caused to remain on the OHP film after the fixation. This leads to difficulties, such as a lowering in transparence of the OHP film, thermal evaporation of the silicone oil and soiling therewith in the image forming apparatus, and also processing of the recovered oil.

As another method, it has been proposed and practiced to add waxes, such as low-molecular weight polyethylene or low-molecular weight polypropylene, which can be efficiently melted on heating, in order to provide an increased toner releasability.

The incorporation of waxes in toner particles have been proposed in JP-B 52-3304, JP-B 52-3305 and JP-A 57-52574.

The addition of waxes in toners has been also proposed in JP-A 3-50559, JP-A 2-79860, JP-A 1-109359, JP-A 62-14166, JP-A 61-273554, JP-A 61-94062, JP-A 61-138259, JP-A 60-252361, JP-A 60-252360 and JP-A 60-217366.

Such waxes are used for improving the anti-offset property of the toners at low temperatures and high temperatures and for increasing the toner fixability at low temperatures, but is on the other hand liable to cause difficulties of the toner, such as a lowering in storage stability, and a lowering in developing performance due to a temperature increase in the image forming machine and due to migration of the wax at the toner particle surfaces after a long period of standing. Further, the transparence of the OHP film image is also lowered by the wax addition. In view of these difficulties, as small an amount as possible of the wax addition is desirable.

For the above reason, various proposals have been made for improving the toner binder resins. For example, JP-B 51-23354 has proposed a toner comprising a vinyl copolymer having an appropriate degree of crosslinkage obtained through the use of a crosslinking agent and a molecular weight-adjusting agent. JP-B 55-6805 has proposed a toner comprising polymerized units of $\alpha,\beta$-unsaturated ethylenic monomers and having a broadened molecular weight distribution as represented by a ratio of 35–40 between weight-average molecular weight and number-average molecular weight. Further, toners using a blend resin including a vinyl polymer and having specified Tg, molecular weight and gel content, have been proposed, as in publications described below.

It is true that a toner comprising a resin having a broader molecular weight distribution has a broader fixable temperature range between a fixing lower-limit temperature (or a lowest fixable temperature) and an offset temperature (or an offset initiation temperature) than a toner comprising a single resin having a narrower molecular weight distribution. However, such a toner having a broader molecular weight distribution is still accompanied with a difficulty that in a case where a sufficient offset-prevention effect is thought much of, it becomes difficult to achieve a sufficiently low fixing temperature, and on the other hand, in a case where the low-temperature fixability is thought much of, the offset prevention effect is liable to be insufficient.

For example, JP-A 56-158340 has proposed a toner including a binder resin comprising a low-molecular weight polymer and a high-molecular weight polymer. It is practically difficult for the binder resin to contain a crosslinked content, so that it becomes necessary to increase the molecular weight of the high-molecular weight polymer or increase the content of the high-molecular weight polymer in order to increase the anti-offset property at a high performance level. The compositional change in this direction tends to remarkably lower the resultant resin composition, so that it is difficult to attain practically satisfactory results.

As for a toner comprising a blend of a low-molecular weight polymer and a crosslinked polymer, JP-A 58-86558 has disclosed a toner comprising a low-molecular weight polymer and an insoluble and infusible polymer. The proposed toner may exhibit an improved fixability and an improved pulverizability of the resin composition. However, in view of a small Mw/Mn ratio of at most 3.5 between a weight-average molecular weight (Mw) and a number-average molecular weight (Mn) of the low-molecular weight polymer and a large content of 40–90 wt. % of the insoluble and infusible polymer, it is difficult to satisfy the anti-offset property of the toner and the pulverizability of the resin composition in combination at high performance levels. Practically, it is very difficult to produce a toner sufficiently satisfying the fixability and the anti-offset property without using a fixing device equipped with an offset-preventing liquid supply mechanism. Further, as the insoluble and infusible polymer is increased in amount, the melt viscosity in the melt-kneading step for toner production becomes very high, so that a much higher temperature than ordinary temperature is required for the melt-kneading, thus being liable to cause a thermal decomposition of the additives leading to a lowering in toner performances.

JP-A 56-16144 has proposed a toner having at least one peak in each of a molecular weight region of $10^3$–$8\times10^4$ and a molecular weight region of $10^5$–$2\times10^6$ according to a GPC molecular weight distribution. The toner may exhibit improved pulverizability of the binder resin, anti-offset property, prevention of filming or melt-sticking onto the photosensitive member and developing performance. Further improvements in anti-offset property and fixability are desired. It is difficult for the resin to comply with severer demands in these days while providing a further improved fixability and retaining or improving the other properties.

In this way, it is extremely difficult to realize the toner fixing performances, inclusive of low-temperature fixability and anti-offset property, at high performance levels.

JP-A 59-21845, JP-A 59-218460, JP-A 59-219755, JP-A 60-28665, JP-A 60-31147, JP-A 60-45259, JP-A 60-45260 and JP-A 3-197971 have proposed a toner having excellent fixing performances by containing specified amounts of insoluble matter in THF (tetrahydrofuran) or toluene. However, further improvements are desired for satisfying the low-temperature fixability and the continuous image forming performances in combination.

JP-A 60-31147 and JP-A 3-197971 have proposed toners further specifying the molecular weights of soluble matter. However, a further improvement in continue image forming performance is desired.

JP-A 3-251853 has proposed a toner obtained through suspension polymerization and exhibiting several peaks on a molecular weight distribution curve including a lowest molecular weight peak at $5\times10^4$ or below and a highest molecular weight peak at $2\times10^5$ or above. However, a further improvement is desired at present in respect of low-temperature fixability.

JP-A 10-63035 aims at an improved low-temperature fixability by using a binder resin containing a high-molecular weight component and a low-molecular weight component. However, due to a shearing force exerted during toner production, the high-molecular weight component is severed, so that the molecular weight control in the resin preparation stage is not reflected in toner performances, thus failing to satisfy the low-temperature fixability and anti-high-temperature offset property in combination. Further, from the viewpoint of toner viscoelasticity, a viscoelasticity effective for both low-temperature fixability and anti-high-temperature offset property cannot be attained by the molecular weight control of the resin alone.

JP-A 11-24310 also has proposed a toner containing a polyester resin having an Mw/Mn ratio of 10–1000 and also a Fischer-Tropsh wax added thereto. However, for similar reasons as described above, sufficiently good fixing performances cannot be attained.

SUMMARY OF THE INVENTION

A generic object of the present invention is to provide a toner having solved the above-mentioned problems.

A more specific object of the present invention is to provide a toner with excellent low-temperature fixability.

Another object of the present invention is to providing a toner which can be fixed under application of heat and pressure while applying only a minimum amount of oil or omitting the oil application at all.

Another object of the present invention is to provide a color toner capable of forming a high-quality full-color OHP film image excellent in transparence.

Another object of the present invention is to provide a toner with excellent environmental stability.

According to the present invention, there is provided a toner comprising: (i) a binder resin, (ii) a colorant, (iii) a hydrocarbon wax, (iv) a resin composition comprising at least a copolymer unit synthesized by reaction of a styrenic monomer with at least one monomer selected from the group consisting of nitrogen-containing vinyl monomers, carboxyl group-containing monomers, hydroxyl group-containing monomers, acrylate ester monomers and methacrylate ester monomers, and a hydrocarbon unit; and (v) an organometallic compound;

wherein the binder resin (i) comprises a polyester component in a proportion of at least 60 wt. % based on the binder resin (1), and the toner has a molecular weight distribution as measured by gel permeation chromatography (GPC) including a weight-average molecular weight (Mw) of at least $4.0\times10^4$ and a ratio Mw/Mn of at least 50 between the weight-average molecular weight (Mw) and a number-average molecular weight (Mn).

According to another aspect of the present invention, there is provided a heat-fixing method, comprising: causing a fixing member to contact a toner image formed on a recording material, and imparting heat and pressure onto the toner image, thereby fixing the toner image onto the recording material, wherein the toner image is fixed onto a fixing surface of the recording material under application of silicone oil supplied from the fixing member to the fixing surface at a ratio of $0$–$1\times10^{-7}$ g/cm$^2$, and the toner image is formed of the above-mentioned toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
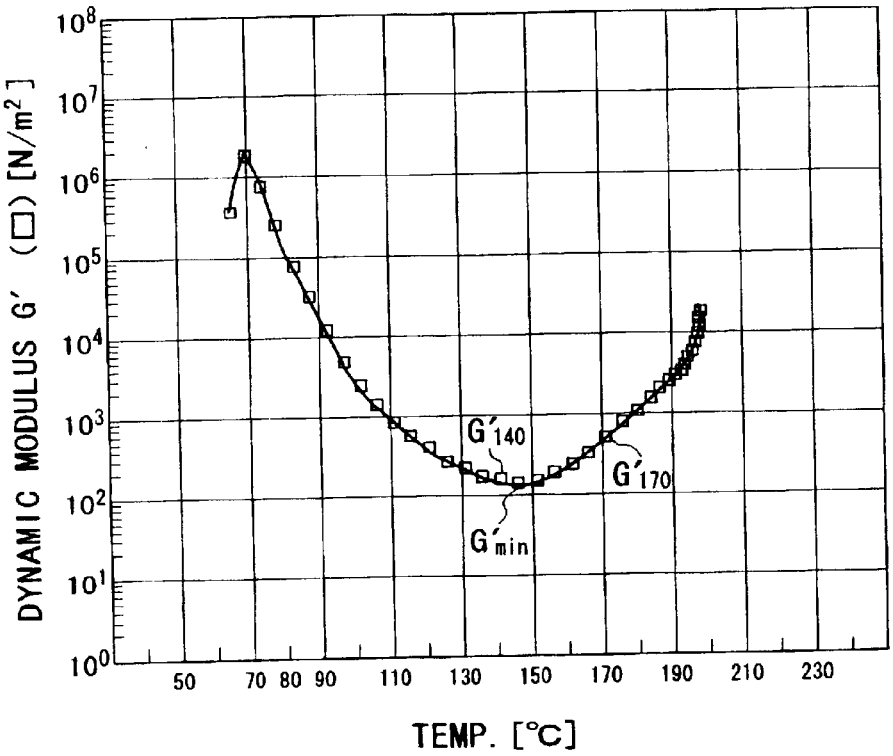
FIG. 1 is a graph showing a dynamic modulus curve of a toner according to the invention.

As a result of our study, it has been found that the toner of the present invention characterized by the above-mentioned features can provide a fixed toner image satisfying a high gloss, a good color miscibility of providing secondary colors and excellent transparence of OHP film image by using a heat-fixing means using no or only a limited amount of offset-prevention oil.

As mentioned above, the toner of the present invention, has a molecular weight distribution as measured by gel permeation chromatography (GPC) including a weight-average molecular weight (Mw) of at least $4.0\times10^4$ an a ratio Mw/Mn of at least 50 between the weight-average molecular weight (Mw) and a number-average molecular weight (Mn).

In a case where the weight-average molecular weight (Mw) of the toner is below $4.0\times10^4$, the storage stability of the toner is liable to be lowered, and in a case where the ratio Mw/Mn is below 50, the toner is liable to show a lower storage stability and an inferior anti-hot offset property, thus resulting in a narrower fixable temperature region.

It is preferred that the toner shows a weight-average molecular weight (Mw) of $4.0\times10^4$–$1.0\times10^7$ and a number-average molecular weight (Mn) of 1500–$1.0\times10^4$. The ratio Mw/Mn may preferably be 100–3000, more preferably 200–2500.

The binder resin (i) for constituting the toner of the present invention is required to comprise at least 60 wt. % of a polyester component. As far as this condition is satisfied, the binder resin (i) may consist of 100 wt. % of a polyester resin, may comprise a form of hybrid resin composition comprising a polyester component and a vinyl polymer component, which are at least partially chemically bonded to each other to form a hybrid resin (component), or can be in a form a mixture of at least 60 wt. % of a polyester resin and another polymer. In a preferred form, the binder resin (i) of the present invention may comprise a form of hybrid resin composition containing 65–95 wt. % of a polyester component, at least a portion of which is chemically bonded to a vinyl polymer component to form a hybrid resin (component). Such a hybrid resin composition may preferably contain 5–60 wt. %, more preferably 5–50 wt. %, of a hybrid resin (component) which comprises a polyester component (or unit) and a vinyl polymer component (or unit) chemically bonded to each other.

For the preparation of a polyester resin (component) as a binder resin (component), an alcohol, and a carboxylic acid, carboxylic anhydride, carboxylate ester, etc., may be used as starting materials.

The polyester resin as a preferred species of the binder resin constituting the toner of the present invention may be formed from an alcohol, and a carboxylic acid, a carboxylic acid anhydride or a carboxylic acid ester, as starting monomers. More specifically, examples of dihydric alcohol may include: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane; ethylene glycol, diethylene glycol, triethylene glycol, 1,2-propylene glycol, 1,4-butanediol, neopentyl glycol, 1,4-butene-diol, 1,5-pentane-diol, 1,6-hexane-diol, 1,4-cyclohexanedimethanol, dipropylene glycol, polyethylene glycol, polypropylene glycol, polytetramethylene glycol, bisphenol A and hydrogenated bisphenol A.

Examples of alcohols having three or more hydroxy groups for providing a nonlinear polyester resin may include: sorbitol, 1,2,3,6-hexane-tetrol, 1,4-sorbitan, pentaerythritol, dipenta-erythritol, tripentaerythritol, 1,2,4-butanetriol, 1,2,5-pentanetriol, glycerol, 2-methylpropanetriol, trimethylolethane, trimethylol propane, and 1,3,5-trihydroxymethylbenzene. Such an alcohol having three or more hydroxy groups may preferably be used in an amount of 0.1–1.9 mol. % of the total monomers.

Examples of the acid may include: aromatic dicarboxylic acids, such as phthalic acid, isophthalic acid and terephthalic acid, and anhydrides thereof; alkyldicarboxylic acids, such as succinic acid, adipic acid, sebacic acid and azelaic acid, and anhydrides thereof; alkyl-substituted succinic acids substituted with an alkyl group having 6–12 carbon atoms, and anhydrides thereof; and unsaturated dicarboxylic acids, such as fumaric acid, maleic acid and citraconic acid, and anhydrides thereof.

Further, examples of polybasic acids having three or more acidic groups for providing a nonlinear polyester resin may include: 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and esters of these acids. Such a polybasic acid may preferably be used in an amount of 0.1–1.9 mol. % of the total monomers.

Among polyester resins formed by reaction between the above-mentioned diols and acids, those formed as polycondensates between a bisphenol derivative represented by formula (1) shown below, and a carboxylic acid selected from carboxylic acids having two or more carboxyl groups, anhydrides thereof or lower alkyl ester thereof (e.g., fumaric acid, maleic acid, maleic anhydride, phthalic acid, terephthalic acid, trimellitic acid, and pyromellitic acid), are preferred so as to provide a color toner having a good chargeability:

(1)

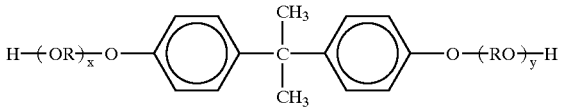

wherein R denotes an ethylene or propylene group, x and y are independently a positive integer of at least 1 with the proviso that the average of x+y is in the range of 2–10.

In the case of using a polyester resin as the toner binder resin, it is particularly preferred to use a polyester resin having a carboxylic group, especially a polyester resin having a molecular skeleton represented by a formula (A) below:

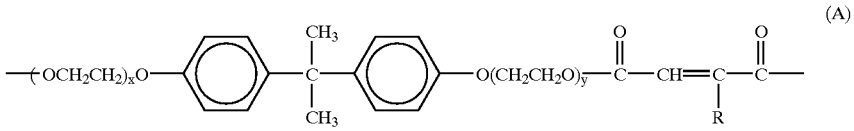

(A)

wherein x and y are independently an integer of at least 1 giving an average of x+y in a range of 2–4; and R denotes H or an alkyl or alkenyl group having 1–20 carbon atoms.

Such a polyester resin having a molecular skeleton of the formula (A) can easily form a metal iron crosslinkage structure at the time of melt-kneading together with an organometallic compound as will be described in more detail hereinafter, thereby providing a toner showing a clear minimum value ($G'_{min}$) on a dynamic modulus curve of the toner.

The hybrid resin composition used as another preferred species of the binder resin constituting the toner of the present invention means a composition containing a hybrid resin comprising a vinyl copolymer unit and a polyester unit chemically bonded to each other. More specifically, such a hybrid resin (composition) may be formed by reacting a polyester unit with a vinyl polymer unit obtained by polymerization of a monomer having a carboxylate ester group such as a (meth)acrylate ester or with a vinyl polymer unit obtained by polymerization of a monomer having a carboxyl group such as (meth)acrylic acid through transesterification or polycondensation. Such a hybrid resin may preferably assume a form of a graft copolymer (or a block copolymer) comprising the polyester unit as a trunk polymer and the vinyl polymer unit as the branch polymer.

Examples of a vinyl monomer to be used for providing the vinyl polymer unit of the hybrid resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polylenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of carboxy group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing vinyl monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl)styrene.

The above-mentioned vinyl monomers may be used singly or in combination of two more species, but preferably in two or more species in combination so as to provide a vinyl polymer unit in the form of a vinyl copolymer.

In the binder resin according to the present invention, the vinyl polymer unit can include a crosslinking structure obtained by using a crosslinking monomer having two or more vinyl groups, examples of which are enumerated hereinbelow. Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds.

Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

In the present invention, it is preferred that the vinyl polymer component and/or the polyester resin component contain a monomer component reactive with these resin components. Examples of such a monomer component constituting the polyester resin and reactive with the vinyl resin may include: unsaturated dicarboxylic acids, such as phthalic acid, maleic acid, citraconic acid and itaconic acid, and anhydrides thereof. Examples of such a monomer component constituting the vinyl polymer and reactive with the polyester resin may include: carboxyl group-containing or hydroxyl group-containing monomers, and (meth)acrylate esters.

In order to obtain a binder resin mixture containing a reaction product between the vinyl resin and polyester resin, it is preferred to effect a polymerization reaction for providing one or both of the vinyl resin and the polyester resin in the presence of a polymer formed from a monomer mixture including a monomer component reactive with the vinyl resin and the polyester resin as described above.

Examples of polymerization initiators for providing the vinyl polymer unit according to the present invention may include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexane-carbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The binder resin for constituting the toner according to the present invention may for example be produced according to the following methods (1)–(6):

(1) The vinyl resin, the polyester resin and the hybrid resin are separately formed and then blended. The blending may be performed by dissolving or swelling the resins in an organic solvent, such as xylene, followed by distilling-off of the organic solvent. The hybrid resin may be produced as a copolymer by dissolving or swelling a vinyl resin and a polyester resin prepared separately in advance in a small amount of an organic solvent, followed by addition of an esterification catalyst and an alcohol and heating to effect transesterification.

(2) A vinyl resin is first produced, and in the presence thereof, a polyester resin and hybrid resin component are produced. The hybrid resin component may be produced through a reaction of the vinyl resin (and a vinyl monomer optionally added) with polyester monomers (such as an alcohol and a carboxylic acid) and/or a polyester. Also in this case, an organic solvent may be used as desired.

(3) A polyester resin is first produced, and in the presence thereof, a vinyl resin and a hybrid resin component are produced. The hybrid resin component may be produced through the reaction of the polyester resin (and polyester monomers optionally added) with vinyl monomers and/or a vinyl resin in the presence of an esterification catalyst.

(4) A vinyl resin and a polyester resin are first produced, and in the presence of these resins, vinyl monomers and/or polyester monomers (alcohol and carboxylic acid) are added thereto for polymerization and transesterification. Also this instance, an organic solvent may be used as desired.

(5) A hybrid resin is first prepared, and then vinyl monomers and/or polyester monomers are added to effect addition polymerization and/or polycondensation. In this instance, the hybrid resin may be one prepared in the methods of (2)–(4), or may be one produced through a known process. An organic solvent may be added as desired.

(6) Vinyl monomers and polyester monomers (alcohol and carboxylic acid) are mixed to effect addition polymerization and polycondensation successively to provide a vinyl resin, a polyester resin and a hybrid resin component. An organic solvent may be added as desired.

In the above methods (1)–(5), the vinyl resin and/or the polyester resin may respectively comprise a plurality of polymers having different molecular weights and crosslinking degrees.

As mentioned above, the binder resin constituting the toner of the present invention comprises at least 60 wt. % of a polyester component. As far as this condition is satisfied, the binder resin may assume a form a mixture of the polyester resin or hybrid resin and a vinyl copolymer, or a mixture of the polyester resin and the hybrid resin.

The binder resin used in the present invention may preferably include a resin having a carboxyl group at its molecular terminal. Such a resin can easily form a meta iron crosslinkage structure at the time of melt-kneading together with an organometallic compound, such as a metal compound of an aromatic oxycarboxylic acid or an aromatic alkoxycarboxylic acid.

In the case of producing the toner through a melt-kneading step, the melt-kneading temperature may preferably be at least 80° C., more preferably 100–200° C., as an actually measured temperature.

If the melt-kneading temperature is below 80° C., the binder resin may not be fully melted, so that the dispersibility of the colorant and the wax is lowered to result in inferior transparence of OHP film and fixing performances and also adversely affect the charging stability. On the other hand, if the melt-kneading temperature exceeds 200° C., some resin components are liable to decompose to lower the fixing performances. As mentioned above, a metal ion crosslinkage structure is formed at the time of melt-kneading of the binder resin together with an organometallic compound which will be described in more detail.

Referring to FIG. 1, for example, which shows a dynamic modulus curve of a toner similar to those obtained in Examples described hereinafter, the toner exhibits a dynamic modulus at 170° C. ($G'_{170}$) which is higher than a dynamic modulus at 140° C. ($G'_{140}$), thus exhibiting a higher dynamic modulus on a higher temperature side and a clear minimum value of dynamic viscosity in a temperature range of 100–200° C. As a result, the toner is extremely excellent in anti-high-temperature offset property.

Figure 2:
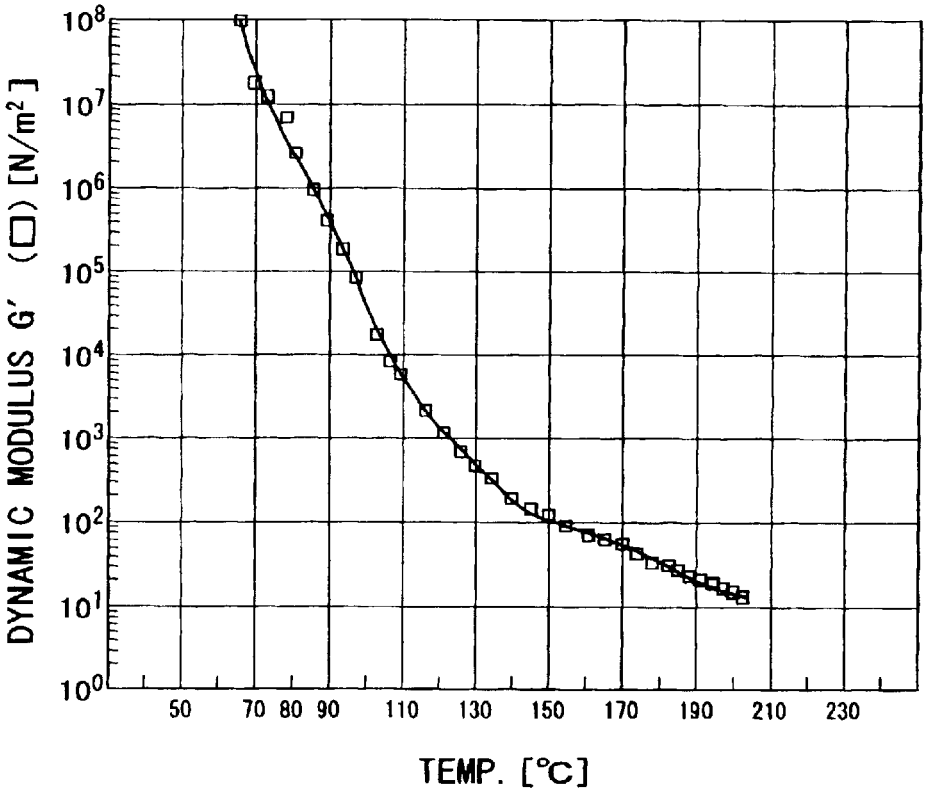
FIG. 2 is a graph showing a dynamic modulus curve of a conventional toner.

On the other hand, a conventional toner similar to those obtained in Comparative Examples described hereinafter provides a dynamic modulus curve as shown in FIG. 2 failing to exhibit a clear minimum of dynamic modulus in a temperature of 100–200° C. but exhibits a dynamic modulus which decreases monotonously on a higher temperature side. Such a toner exhibits inferior anti-high-temperature offset property and a narrower fixable temperature region than the toner of the present invention.

As mentioned above, the toner of the present invention is characterized by viscoelasticity characteristics giving a dynamic modulus (G') curve showing a minimum in a temperature range of 100–200° C., more specifically 120–180° C. It is further preferred that the toner exhibits viscoelastic properties inclusive of a dynamic modulus at 80° C. ($G'_{80}$) of $5\times10^4$–$1\times10^9$ N/m$^2$, dynamic moduli over a temperature range of 120–180° C. ($G'_{120-180}$) in a range of $1\times10^2$–$1\times10^5$ N/m$^2$, and a loss tangent characteristic satisfying:

$1<\tan\delta_{180}/\tan\delta_{min}$, wherein, $\tan\delta_{180}$ represents a loss tangent $\tan\delta$ (=G"/G', i.e., a ratio between a loss modulus G" and a dynamic modulus G') at 180° C. and $\tan\delta_{min}$ represents a minimum of loss tangent $\tan\delta$ in a temperature range of 120–180° C.

The reason why the polyester resin having a molecular skeleton represented by the above-mentioned formula (A) exhibits a peculiar interaction with an organometallic compound, such as a metal compound of an aromatic carboxylic acid derivative, has not been fully clarified as yet, but may be attributable to the flexibility of the molecular chain favoring the formation of a ligand form facilitating the coordination (molecular disposition interaction), and an interaction of the electron-donating property of the phenyl group having an electron-donating group at its p-position and the π-electron-donating property of —CH═C(R)—.

The binder resin as a starting material for providing the toner of the present invention may preferably contain a THF-soluble content showing a molecular weight distribution according to GPC including a number-average molecular weight (Mn) of 1300–9500, a weight-average molecular weight (Mw) of 2600–$1.9\times10^5$ and a ratio Mw/Mn of 2–20. The binder resin may preferably have an acid value of 1–60 mgKOH/g, more preferably 5–60 mgKOH/g, particularly preferably 7–50 mgKOH/g.

A binder resin having a number-average molecular weight (Mn) of below 1300 or a weight-average molecular weight (Mw) of below 2600 is liable to result in a toner which provides a fixed toner image showing apparently high surface smoothness and clear appearance but is liable to cause high-temperature offset phenomenon in continuous image formation. Further, the toner is liable to exhibit a lower stability in long-term storage and cause difficulties, such as toner melt-sticking in the developing device and surface soiling of the carrier particles to result in increased spent carrier. Further, during the melt-kneading of toner ingredients for toner production, it becomes difficult to exert a sufficient shearing force, thus resulting in insufficient dispersion of the colorant which leads to a lowering in coloring power and a fluctuation of toner chargeability.

On the other hand, in the case where the binder resin has a number-average molecular weight (Mn) of above 9500 or a weight-average molecular weight (Mw) of above $1.9\times10^5$, the binder resin is liable to result in a toner which may exhibit excellent anti-offset property but requires a high fixing temperature. Further, even if the colorant dispersion can be controlled, the resultant toner image is caused to have a lower surface smoothness and exhibit lower color reproducibility.

An Mw/Mn ratio below 2 of the binder resin is generally caused when the molecular weight per se is low. Accordingly, similarly as in the above-mentioned case of lower molecular weight, the resultant toner is liable to have difficulties, such as high-temperature offset phenomenon in continuous image formation, a lower stability in long-term storage, toner melt-sticking in the developing device, spent carrier, and fluctuation in toner chargeability.

In the case of a binder resin having an Mw/Mn ratio exceeding 20, the resultant toner may exhibit excellent anti-high-temperature offset property but requires a high fixing temperature. Further, even if the colorant dispersion can be controlled, the resultant toner image is caused to have a lower surface smoothness, and exhibit lower color miscibility of secondary color, thus resulting in a lower color reproducibility.

In the case of using a binder resin having an acid value below 1 mgKOH/g, the resultant toner is liable to have an excessively high charge during continuous image formation, i.e., cause so-called "charge-up phenomenon", thus failing to maintain a stable image density over a long period.

In the case of using a binder resin having an acid value exceeding 60 mgKOH/g, the resultant toner is less liable to be excessively charged but is liable to cause "white background fog" due to so-called "charge-down" phenomenon, thus resulting in lower image quality.

In the case of producing the toner of the present invention through melt-kneading, it is preferred to charge the binder resin into a kneading machine after pulverization into particles of at most 1000 μm in average particle size, more preferably an average particle size of 5–500 μm. If the average particle size exceeds 1000 μm, the dispersibility of the colorant and wax is liable to be lowered.

In the toner of the present invention, a hydrocarbon wax is contained as the release agent (wax). Specific examples thereof may include: aliphatic hydrocarbon waxes, such as low-molecular weight polyethylene, low-molecular weight polypropylene, microcrystaline wax, and paraffin wax; oxidation products of such aliphatic hydrocarbon waxes, such as oxidized polyethylene wax; and block copolymers of such aliphatic hydrocarbon waxes. It is particularly preferred to use an aliphatic hydrocarbon wax, such as paraffin wax.

The hydrocarbon wax used in the present invention may preferably exhibit a thermal behavior as to provide a DSC heat-absorption curve on temperature increase showing a peaktop temperature of maximum heat-absorption peak in a range of 55–80° C., and may preferably be contained in an amount of 0.1–10 wt. parts, more preferably 0.1–6 wt. parts, per 100 wt. parts of the binder resin.

In a case where the wax amount is below 0.1 wt. part, the release effect becomes insufficient, especially when the fixing oil application is omitted or minimized. Above 10 wt. parts, the colorant dispersion is liable to be obstructed to result in a lowering in saturation of the resultant color toner image.

In the case of using a wax having a maximum heat-absorption peak temperature below 55° C., the temperature is liable to be lower than the glass transition temperature of the binder resin used in the present invention, so that the wax is liable to be melted out to the toner particle surfaces when left to stand in a high temperature environment, thus exhibiting a lower anti-blocking property. On the other hand, in the case of using a wax showing a maximum heat-absorption peak temperature above 80° C., the wax is liable to fail in quick migration to the melted toner surface at the time of toner melt fixation, so that high-temperature offset is liable to be caused due to inferior release effect.

The hydrocarbon wax may preferably exhibit a molecular weight distribution according to GPC including a weight-average molecular weight (Mw) of 400–800, a number-average molecular weight (Mn) of 400–600 and an Mw/Mn ratio of 1.0–2.0.

In the case of using a hydrocarbon wax having an Mn below 400 or an Mw below 600, the resultant toner is liable to have a lower anti-blocking property.

In the case of using a hydrocarbon wax having an Mn above 600 or an Mw above 800, or having an Mw/Mn ratio exceeding 2.0, the wax is liable to fail in quick migration to the melted toner surface at the time of toner melting fixation, so that the toner is liable to show inferior releasability, thus resulting in high-temperature offset.

The binder resin and the hydrocarbon wax used in the present invention inherently exhibit poor mutual solubility with each other, so that if they are separately added as they are to produce the toner, the wax is liable to be localized in the resultant toner particles and also result in isolated wax particles, thus resulting in difficulties, such as white dropout in the resultant image and charging failure of the toner.

For obviating the above difficulties, the toner of the present invention is produced by using as a wax-dispersing agent a resin composition comprising a hydrocarbon unit, and a copolymer unit synthesized by reaction of a styrenic monomer with at least one monomer selected from the group consisting of nitrogen-containing vinyl monomers, carboxyl group-containing monomers, hydroxyl group-containing monomers, acrylate ester monomers and methacrylate ester monomers, in the presence of the hydrocarbon, so as to chemically bond the copolymer unit with the hydrocarbon unit. Thus, for the production of the toner according to the present invention, the wax can be added together with the binder resin and the other ingredients, but may preferably be first micro-dispersed within the above-prepared resin composition to form a wax-dispersed resin composition, followed by met-mixing of the wax-dispersed resin composition with a part of the binder resin to form a wax-dispersed master batch, so that the wax-dispersed master batch is blended with the remainder of the binder resin and other toner ingredients to be melt-kneaded with each other for the toner production.

Thus, the resin composition (iv) used in the present invention comprises a copolymer unit and a hydrocarbon unit, which are at least partially chemically bonded with each other. The resin composition may preferably comprise the copolymer unit and the hydrocarbon unit in a weight ratio in the range of 60:40 to 95:5. The resin composition may preferably contain a component formed by chemically bonding the copolymer unit and the hydrocarbon unit in a proportion of at least 30 wt. %, more preferably 40 wt. % or more, further preferably 50 t. % or more.

Examples of the styrenic monomer and another monomer selected from nitrogen-containing vinyl monomers, carboxyl group-containing monomers, hydroxyl group-containing monomers, acrylate ester monomers and methacrylate ester monomers, for producing the copolymer unit, may include those enumerated below.

Examples of the styrenic monomer as an essential component for providing the copolymer unit may include: styrene and styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

Examples of the nitrogen-containing vinyl monomers may include: amino group-containing (meth)acrylate esters, such as dimethylaminoethyl methacrylate, and diethylaminoethyl methacrylate; and other nitrogen-containing (meth) acrylic derivatives, such as acrylonitrile, methacrylonitrile and acrylamide.

Examples of the carboxyl group-containing monomers may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butylcitraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

Examples of the hydroxyl group-containing monomers may include: acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl) styrene.

Examples of the acrylate ester monomers may include: methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

Examples of the methacrylate ester monomers may include: methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate.

Among the above, the copolymer unit may preferably comprise a terpolymer of a styrenic monomer, a nitrogen-containing vinyl monomer and a (meth)acrylate ester monomer, particularly styrene-acrylonitrile-butyl acrylate terpolymer.

The copolymer unit may preferably have a weight-average molecular weight (Mw) of $5\times10^3$–$1\times10^5$, a number-average molecular weight (Mn) of $1.5\times10^3$–$1.5\times10^4$ and an Mw/Mn ratio of 2–40, according to GPC.

If the copolymer unit has an Mw below $5\times10^3$ or an Mn below $1.5\times10^3$, or an Mw/Mn ratio below 2, the anti-blocking property of the resultant toner is liable to be remarkably impaired.

On the other hand, if the copolymer unit has an Mw above $1\times10^5$ or a Mn above $1.5\times10^4$ or an Mw/Mn ratio above 40, the resultant toner is liable to cause high-temperature offset because of inferior releasability caused by failure of quick migration to the melted toner surface of the hydrocarbon wax finely dispersed in the resin composition at the time of melt-fixation.

The copolymer unit may be contained in a proportion of 0.1–20 wt. parts per 100 wt. parts of the binder resin. If the copolymer unit is contained in excess of 20 wt. parts, the low-temperature fixability (sharp-melting characteristic) of the binder resin is liable to be impaired to result in a narrower fixable temperature region.

The hydrocarbon unit used for the graft polymerization with the copolymer is a kind of polyolefin and may preferably show a peaktop temperature of a maximum heat-absorption peak (Tabs.) of 90–130° C. on a DSC heat-absorption curve on temperature increase.

If the maximum heat-absorption peak temperature (Tabs) is either below 90° C. or above 130° C., the branch structure of the graft copolymer with the copolymer unit is impaired to fail in fine dispersion of the hydrocarbon wax, so that the hydrocarbon wax is liable to be localized in the resultant toner to result in inferior images, such as white dropout.

The hydrocarbon unit may preferably have a weight-average molecular weight (Mw) of 500–30,000, a number-average molecular weight (Mw) of 500–3000, and an Mw/Mn ratio of 1.0–20, and also have a low density of 0.90–0.95.

If the hydrocarbon unit has an Mw below 500 or an Mn below 500, or has an Mw above 30,000, a Mn above 3000 or a ratio Mw/Mn exceeding 20, an effective degree of exudation of the hydrocarbon wax to be failed to result in inferior anti-high-temperature offset property.

Further, if the hydrocarbon unit has a density above 0.95, the effective branch structure in the resin composition is impaired to result in localization of the hydrocarbon wax during the toner production, thus leading to image defects, such as white dropout.

The hydrocarbon unit may preferably be contained in an amount of 0.1–2 wt. parts per 100 wt. parts of the binder resin.

If the amount of the hydrocarbon unit exceeds 2 wt. parts, similarly as the above, the effective branch structure in the resin composition is liable to be impaired to fail in fine dispersion of the hydrocarbon wax, so that the hydrocarbon wax is liable to be localized in the toner production to result in a toner, which is liable to cause image defects, such as white dropout.

The resin composition (iv) (wax-dispersing agent) may preferably have a GPC molecular weight distribution providing an Mn of 1000–5000, an Mw of 5,000 to 50,000 and a ratio Mw/Mn of 1 to 10.

The organometallic compound used in the present invention may preferably be a metal compound of an aromatic oxycarboxylic acid or an aromatic alkoxycarboxylic acid, and the metal species may preferably comprise a metal having a valence of at least 2. Examples of divalent metals may include: $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$, and among these, $Zn^{2+}$, $Ca^{2+}$, $Mg^{2+}$ and $Sr^{2+}$ are preferred. Examples of metals having a valence of 3 or more may include: $Al^{3+}$, $Cr^{3+}$, $Fe^{3+}$ and $Ni^{3+}$, and among these, $Al^{3+}$ and $Cr^{3+}$ are preferred, and $Al^{3+}$ is particularly preferred.

Examples of the aromatic oxycarboxylic acid may include: salicylic acid, alkylsalicylic acids having an alkyl group having 1–12 carbon atoms, dialkylsalicylic acid having two alkyl groups each having 1–12 carbon atoms, hydroxynaphthoic acid, and alkylhydroxynaphthoic acid, and alkylhydroxynaphthoic acid. Examples of the aromatic alkoxycarboxylic acid may include alkoxylated products of the above-mentioned aromatic oxycarboxylic acids.

In the present invention, di-tert-butylsalicylic acid aluminum compound is particularly preferred as an organometallic acid.

Such a metal compound of an aromatic oxycarboxylic acid or alkoxycarboxylic acid may for example be synthesized through a process of dissolving an aromatic oxycarboxylic acid or alkoxycarboxylic acid in a sodium hydroxide aqueous solution, adding an aqueous solution of a metal having a valence of at least 2 dropwise thereto, and heating under stirring the aqueous mixture, followed by pH adjustment of the aqueous mixture, cooling to room temperature, filtration and washing with water. The synthesis process is not restricted to the above.

The organometallic compound may preferably be used in 0.1–10 wt. parts, per 100 wt. parts of the binder resin so as to provide a toner which causes little fluctuation in initial chargeability to acquire a required level of absolute charge at the time of development, thus resulting in images free from defects, such as fog and image density lowering.

If the content of the organometallic compound is below 0.1 wt. part, the chargeability during continuous image formation is liable to be unstable, thus resulting in an inferior image density stability. If the content of the organometallic compound is above 10 wt. parts, the resultant toner is liable to be excessively charged during continuous image formation, thus resulting in a lowering in image density.

When the toner according to the present invention is constituted as a magnetic toner, the magnetic toner may contain a magnetic material, which also function as a colorant. Examples of such a magnetic material may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide (gamma-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide, magnetic ferrite or gamma-diiron trioxide.

The magnetic material may have an average particle size (Dav.) of 0.1–2 $\mu$m, preferably 0.1–0.5 $\mu$m. The magnetic material may preferably show magnetic properties when measured by application of 796 kA/m (10 kilo-Oersted), inclusive of: a coercive force (Hc) of 1.6–12 kA/m (20–150 Oersted), a saturation magnetization ($\sigma s$) of 50–200 $Am^2/kg$, particularly 50–100 $Am^2/kg$, and a residual magnetization ($\sigma r$) of 2–20 $Am^2/kg$.

The magnetic material may preferably be contained in the toner in a proportion of 5–120 wt. parts, per 100 wt. parts of the binder resin, for providing a magnetic mono-component developer.

In the case of using the toner of the present invention as a non-magnetic monocomponent developer, it is also possible to incorporate such a magnetic material in a proportion of at most 5 wt. parts per 100 wt. parts of the binder resin. If the magnetic material is contained in excess of 5 wt. parts, the surface of the regulating blade or the toner-carrying roller surface is liable to be remarkably damaged (abraded) to cause charging failure. A magnetic material contained in a range of 0.1–5 wt. parts is effective for suppressing toner scattering (i.e., soiling with the toner in the image forming apparatus) over a long period of use.

In a case of using the toner of the present invention for providing a two-component developer in mixture with magnetic carrier particles, it is also possible to incorporate such a magnetic material in the toner in a proportion of at most 5 wt. parts per 100 wt. parts of the binder resin. The inclusion of such a magnetic material in a range of 0.1–5 wt. parts is also effective for increasing the magnetic constraint force exerted by the developer-carrying roller to suppress the toner scattering over a long period of service. If the content exceeds 5 wt. parts, the magnetic constraint force exerted by the developer-carrying roller is excessively increased to result in a lowering in image density.

The colorant used in the present invention may also comprise a pigment and/or a dye.

Examples of the dye may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigment may include: Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Pigment Green B, Malachite Green Lake, and Final Yellow Green G.

Examples of colorants for constituting two-component developers for full color image formation may include the following.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments having a phthalocyanine skeleton to which 1–5 phthalimidomethyl groups are added.

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 1–15 wt. parts, preferably 3–12 wt. parts, more preferably 4–10 wt. parts, per 100 wt. parts of the binder resin.

A colorant content in excess of 15 parts is liable to provide a toner which shows a lower transparence, a lower reproducibility of an intermediate color as represented by a human skin color and a lower charge stability leading to a difficulty in attaining an objective level of charge. If the colorant content is lower than 1 wt. part, it becomes difficult to attain an objective level of coloring power and also a high quality image of a high image density.

A flowability-improving agent may preferably be added to the toner particles so as to improve the image quality.

Examples of such a flowability improving agent may include: powder of fluorine-containing resin, such as polyvinylidene fluoride fine powder and polytetrafluoroethylene fine powder; fine powdery silica such as wet-process silica and dry-process silica, and treated silica obtained by surface-treating (hydrophobizing) such fine powdery silica with silane coupling agent, titanium coupling agent, silicone oil, etc.; titanium oxide fine powder, hydrophobized titanium oxide fine powder; aluminum oxide fine powder, and hydrophobized aluminum oxide fine powder.

The flowability-improving agent may preferably have a specific surface area as measured by nitrogen adsorption according to the BET method of at least 30 $m^2/g$, more preferably at least 50 $m^2/g$, so as to provide a good result. The flowability-improving agent may be added in 0.01–8 wt. parts, preferably 0.1–4 wt. parts, per 100 wt. parts of the toner.

The toner particles may be prepared by blending the binder resin, colorant, organometallic compound and other optical additives by a blender, such as a Henschel mixer or a ball mill; melt-kneading the blend by a hot kneading means, such as a kneader or an extruder, followed by cooling for solidification of the melt-kneaded product, pulverization of the solidified product, and classification of the pulverized product to obtain toner particles of a prescribed average particle size.

The toner particles are further blended with a flowability-improving agent sufficiently by a blender, such as a Henschel mixer, to obtain a toner comprising the flowability-improving agent attached to the toner particle surfaces.

The toner according to the present invention may preferably have a weight-average particle size (D4) of 3.0 to 15.0 $\mu$m, more preferably 4.0 to 12.0 $\mu$m.

If the weight-average particle size (D4) is below 3.0 $\mu$m, it becomes difficult to stabilize the chargeability and liable to result in fog or toner scattering in continuous image formation. If D4 is above 15.0 $\mu$m, the reproducibility of halftone images is remarkably lowered to result in apparently rough images.

Next, an embodiment of the full-color image forming method using the toner of the present invention will now be described with reference to FIG. 5.

Figure 5:
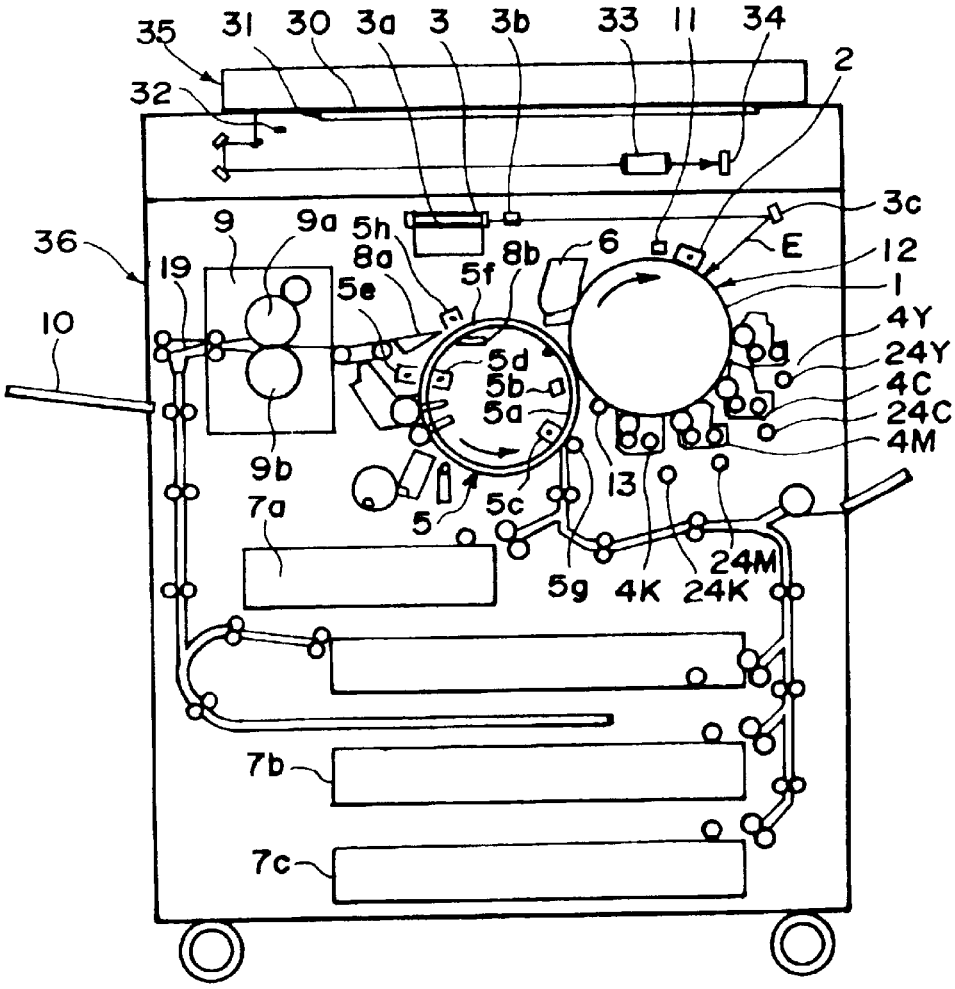
FIG. 5 is a schematic sectional view of an example of image forming apparatus suitable for using a toner of the invention.

FIG. 5 illustrates an embodiment of image forming apparatus for forming full-color images according to electrophotography. The apparatus may be used as a full-color copying apparatus or a full-color printer.

In the case of a full-color copying apparatus, the apparatus includes a digital color image reader unit 35 at an upper part and a digital color image printer unit 36 at a lower part as shown in FIG. 5.

Referring further to FIG. 5, in the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not show) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system 3 (3*a*, 3*b*, 3*c*), a potential sensor 12, four developing devices containing developers different in color (4Y, 4C, 4M, 4B), a luminous energy (amount of light) detection means 13, a transfer device 5, and a cleaning device 6 are disposed.

In the laser exposure optical system 3, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit 36, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing device to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device 5 includes a transfer drum 5*a*, a transfer charger 5*b*, an adsorption charger 5*c* for electrostatically adsorbing a transfer material, an adsorption roller 5*g* opposite to the adsorption charge 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a transfer material-carrying member for carrying the recording material is integrally adjusted. The transfer sheet 5*f* may include resin film, such as a polycarbonate film.

A transfer material is conveyed from any one of cassettes 7*a*, 7*b* and 7*c* to the transfer drum 5*a* via a transfer material-conveying system, and is held on the transfer drum 5*a*. The transfer material carried on the transfer drum 5*a* is repeatedly conveyed to a transfer position opposite to the photosensitive drum 1 in accordance with the rotation of the transfer drum 5*a*. The toner image on the photosensitive drum 1 is transferred onto the transfer material by the action of the transfer charger 5*b* at the transfer position.

A toner image on the photosensitive member 1 may be directly transferred onto a transfer material as in the embodiment of FIG. 5, or alternatively once transferred onto an intermediate transfer member (not shown) and then to the transfer material.

The above image formation steps are repeated with respect to yellow (Y), magenta (M), cyan (C) and black (B) to form a color image comprising superposed four color toner images on the transfer material carried on the transfer drum 5.

The transfer material thus subjected to transfer of the toner image (including four color images) is separated from the transfer drum 5 by the action of a separation claw 8*a*, a separation and pressing roller 8*b* and the separation charger 5*h* to be conveyed to heat-pressure fixation device, where the full-color image carried on the transfer material is fixed under heating and pressure to effect color-mixing and color development of the toner and fixation of the toner onto the transfer material to form a full-color fixed image (fixed full-color image), followed by discharge thereof into a tray 10. As described above, a full-color copying operation for one sheet of recording material is completed.

In the full-color image operation, the fixing operation in the heat-pressure fixing device is performed at a process speed (e.g., 90 mm/sec) smaller than a process speed or a developing speed (e.g., 160 mm/sec) on the photosensitive drum 1. Such a smaller fixing speed than the developing speed is adopted so as to supply an ample heat for melt-mixing the superposed two to four-layer superposed yet-unfixed toner layers.

Figure 6:
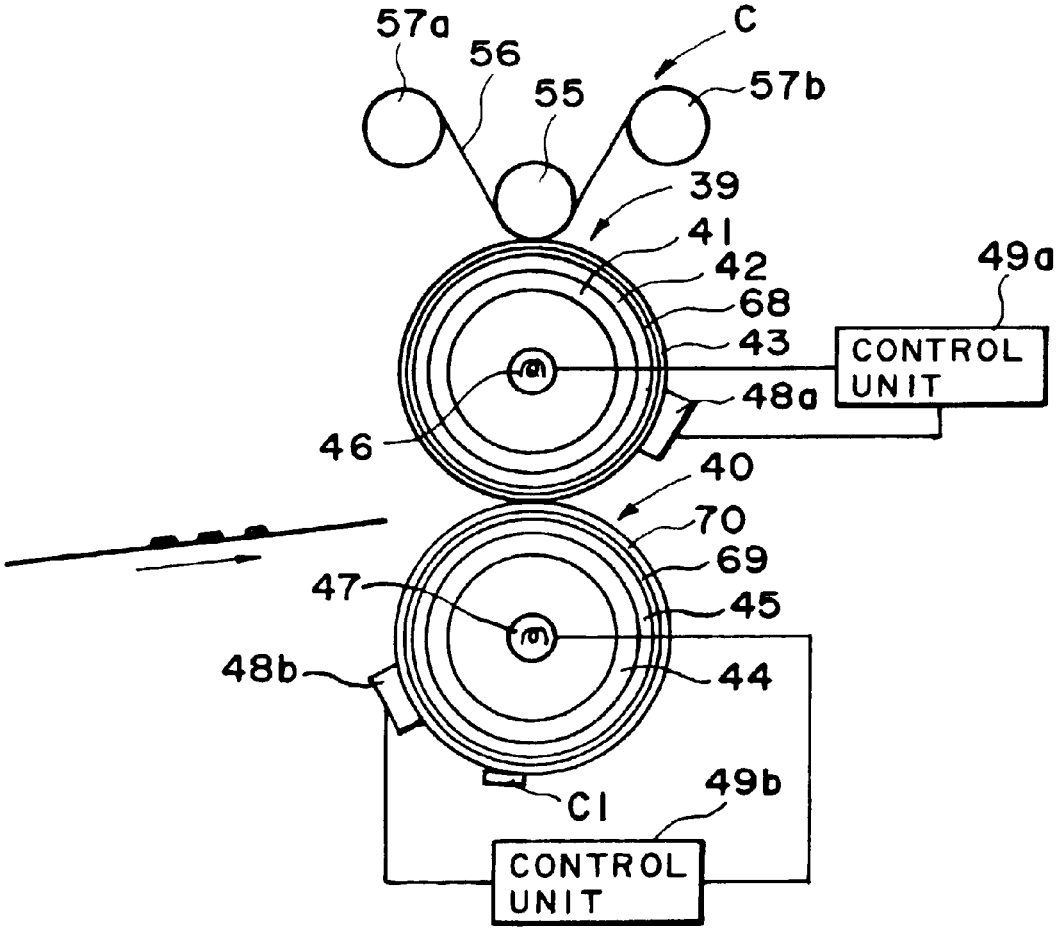
FIG. 6 is a schematic sectional illustration of a heat-pressure fixing device.

FIG. 6 is a schematic sectional view for illustrating an organization of such a heat-pressure fixing device. Referring to FIG. 6, the fixing device includes a fixing roller 39 as a fixing means, which comprises an e.g., 5 mm-thick aluminum metal cylinder 41, and the cylinder 41 is coated with a 3 mm-thick RTV (room temperature-vulcanized) silicone rubber layer 42 (having a JIS-A hardness of 20 deg.) and further with a 50 μm-thick polytetrafluoroethylene (PTFE) layer 43. On the other hand, a pressure roller 40 as a pressure means comprises an e.g., 5 mm-thick aluminum-made metal cylinder 44, which is coated with a 2 mm-thick RTV silicone rubber layer 55 (JIS-A hardness of 40 deg.) and then with a 150 μm-thick PTFE layer 70.

In the embodiment of FIG. 6, the fixing roller 39 and the pressure roller 40 both have a diameter of 60 mm. As the pressure roller 40 has a higher hardness, however, a blank transfer paper carrying no toner image is discharged in a direction which is somewhat deviated toward the pressure roller 40 from a line perpendicular to a line connecting the axes of these two rollers. The deviation of the discharge direction toward the pressure roller side is very important for obviating clinging or winding about the fixing roller of a transfer or recording paper for carrying a large-area copy image to be fixed thereon. The deviation of the paper discharge direction may be effected not only by utilizing the above-mentioned hardness difference but also by using a pressure roller having a smaller diameter than the fixing roller or by using a pressure roller set at a higher temperature than the fixing roller so as to preferentially vaporize the moisture from the back (i.e., the pressure roller side) of the fixing paper, thereby causing a slight paper shrinkage.

The fixing roller 39 is provided with a halogen heater 46 as a heating means, and the pressure roller 40 is also provided with a halogen heater 47, so as to allow heating of a fixing paper from both sides. The temperatures of the fixing roller 39 and the pressure roller 40 are detected by thermistors 48*a* and 48*b* abutted against the fixing and pressure rollers 39 and 40, respectively, and the energization of the halogen heaters 46 and 47 is controlled based on the detected temperatures, whereby the temperatures of the fixing roller 39 and the pressure roller 40 are both controlled at constant temperatures (e.g., 160° C.±10° C.) by controllers 49*a* and 49*b*, respectively. The fixing roller 39 and the pressure roller 40 are pressed against each other at a total force of 390N (40 kg.f) by a pressure application mechanism (not shown).

The fixing device also incudes a fixing roller cleaning device C equipped with oil-impregnated web, and also a cleaning blade C1 for removing oil and soil attached to the pressure roller 40. A paper or unwoven cloth web 56 is impregnated with a silicone oil having a viscosity of 50–3000 cSt, such as dimethylsilicone oil or diphenylsilicone oil, which is preferred so as to allow a constant oil supply at a small rate and provide high-quality fixed images with uniform gloss and free from oil trace. In the case of no oil application, the cleaning device C may be removed or operated by using a paper or cloth web 56 not impregnated with oil, or may be replaced by a cleaning blade, a cleaning pad or a cleaning roller.

In a specific example, the cleaning device C was equipped with a web 56 of non-woven cloth pressed against the fixing roller 39 while the web 46 was fed little by little from a feed roll 57*a* to a take-up roller 57*b* so as to prevent the accumulation of waste toner, etc.

As the toner of the present invention is excellent in low-temperature fixability and anti-high-temperature offset characteristic, the application amount of the release agent, such as silicone oil, can be reduced and the cleaning device C is less liable to be soiled.

A toner image formed of the toner according to the present invention may suitably be fixed under pressure at a fixing roller surface temperature of 150° C.±30° C. while applying substantially no oil or silicone oil at a rate of at most $1\times10^{-7}$ g/cm$^2$ of recording material (transfer material) surface area from the fixing member onto the toner image fixing surface of the recording material.

If the application amount exceeds $1\times10^{-7}$ g/cm$^2$, the fixed image on the recording material is liable to glitter, thus lowering the recognizability of character images.

By using the image forming systems shown in FIGS. 1 and 2, for example, a color toner image comprising at least a toner according to the present invention is formed on a recording material (i.e., transfer material) sheet in a fixed state to provide a color image.

Various properties characterizing the toner of the present invention described herein are based or values measured according to the following methods.

(1) Acid Value (JIS Acid Value)

A sample in an amount of 2–10 g is weighed into a 200 to 300 ml-Erlenmeyer flask, and ca. 50 ml of a solvent mixture of methanol/toluene (=30/70) is added thereto to dissolve the sample. In case of poor solubility, a small amount of acetone may be added. A mixture indicator of 0.1% Brome Thymol Blue and Phenol red is used for titration of the sample solution with a preliminarily standardized N/10-solution of potassium hydroxide (KOH) in alcohol. Based on the KOH solution used for the titration, the acid value is calculated according to the following equation.

$$\text{Acid value}=\text{KOH (mol)}\times f\times 56.1/\text{sample weight},$$

wherein f denotes a factor of N/10–KOH solution.

(2) Molecular Weight Distribution by GPC (THF-Soluble Content of Toner, Binder Resin, Copolymer Unit, etc.)

A resinous sample (including a toner sample) is dissolved in THF and subjected to 6 hours of extraction with THF under refluxing by a Soxhlets extractor to form a GPC sample.

In the GPC apparatus, a column is stabilized in a heat chamber at 40° C., tetrahydrofuran (THF) solvent is caused to flow through the column at that temperature at a rate of 1 ml/min., and ca. 50–200 $\mu$l of a GPC sample solution adjusted at a resin concentration of 0.05–0.6 wt. % is injected.

The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

(3) Molecular Weight Distribution by GPC (Hydrocarbon Unit, Hydrocarbon Wax, etc.)

GPC measurement was performed under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

(4) Maximum Heat-Absorption Peak-Top Temperature (Tabs) (Wax and Toner)

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed. The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a maximum heat-absorption peak appears at a temperature (Tabs) in the range of 30–200° C. on a DSC curve. In the case of plural heat-absorption peaks, the peak-top temperature of a maximum heat-absorption peak is taken as Tabs.

(5) Particle Size Distribution of Toner or Toner Particles

Coulter counter Model TA-II or Coulter Multisizer (available from Coulter Electronics Inc.) may be used as an instrument for measurement. For measurement, a 1%-NaCl aqueous solution as an electrolyte solution is prepared by using a reagent-grade sodium chloride (e.g., "ISOTON II" (trade name), available from Coulter Scientific Japan Co. may be commercially available). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 $\mu$m by using the above-mentioned apparatus with a 100 micron-aperture to obtain a volume-basis distribution and a number-basis distribution. From the results of the volume-basis distribution, the weight-average particle size (D4) and volume-average particle size (Dv) of the toner may be obtained (while using a central value for each channel as the representative value of the channel).

The following 13 channels are used: 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m 10.08–12.70 $\mu$m; 12.70–16.00 $\mu$m; 16.00 20.20 $\mu$m; 20.20–25.40 $\mu$m; 25.40–32.00 $\mu$m; 32–40.30 $\mu$m.

(6) Viscoelasticity

A sample toner is molded under pressure to form a disk of 25 mm in diameter and ca. 2–3 mm in thickness. The disk sample is placed in a holder of parallel plates each in a diameter of 25 mm and subjected to measurement in a temperature range of 50–200° C. under a temperature-raising rate of 2° C./min by using a visco-elasticity measurement apparatus ("RHEOMETER RDA-II", available from Rheometrics Co) according to the automatic measurement mode under the conditions including a measurement strain initial set value of 0.01% and fixed angular frequency (w) of 6.28 rad/sec. The measured values of dynamic modulus (G') are taken on the ordinate versus the temperatures taken on the abscissa to read the respective values at relevant temperatures.

EXAMPLES

Hereinbelow, some specific Examples are raised regarding the production and evaluation of the toner according to the present invention, but these Examples should not be construed to restrict the scope of the present invention.

<Hybrid Resin (Composition)>

Production Example 1

As starting materials for a vinyl copolymer, 2.0 mol of styrene, 0.21 mol of 2-ethylhexyl acrylate, 0.16 mol of fumaric acid, 0.03 mol of α-methylstyrene dimer and 0.05 mol of dicumyl peroxide were placed in a dropping funnel.

Separately, for preparation of a polyester, 7.0 mol of polyoxypropylene(2.2)-2,2-bis(4-hydroxy-phenyl)propane, 3.0 mol of polyoxyethylene(2.2)-2,2-bis(4-hydroxyphenyl) propane, 3.0 mol of terephthalic acid, 2.0 mol of trimellitic anhydride, 5.0 mol of fumaric acid and 0.2 g of dibutyltin oxide were placed in a glass-made 4 liter four-necked flask, which was then equipped with a thermometer, a stirring bar, a condenser and a nitrogen-intake pipe, and placed on a mantle heater. Then, the interior of the flask was aerated with nitrogen and then the system was gradually heated under stirring. At 140° C., under continued stirring, the starting materials for the vinyl copolymer including the polymerization initiator in the dropping funnel were added dropwise into the system over 4 hours. Then, the system was heated to 200° C. for 4 hours of reaction to obtain Hybrid resin (1). The results of GPC and acid value measurement for Hybrid resin (1) are shown in Table 1 together with those of the resins obtained in the following Production Examples.

Production Examples 2 to 5

Hybrid resins (2) to (5) were respectively prepared in the same manner as in Production Example 1 except for the monomer prescriptions and reaction time.

Production Example 1 for Polyester Resin 3.5 mol of polyoxypropylene(2.2)-2,2-bis(4-hydroxyphenyl)propane, 1.5 mol of polyoxyethylene-(2.2)-2,2-bis(4-hydroxyphenyl)propane, 1.5 mol of terephthalic acid, 1.0 mol of trimellitic anhydride, 2.5 mol of fumaric acid and 0.1 g of dibutyltin oxide were placed in a glass-made 4-liter four-necked flask, which was then equipped with a thermometer, a stirring bar, a condenser and a nitrogen-intake pipe and placed on a mantle heater. In a nitrogen atmosphere, the system was subjected to 5 hours of reaction at 220° C. to obtain Polyester resin (1).

Production Example 1 for Vinyl Copolymer 2.0 mol of styrene, 0.21 mol of 2-ethylhexyl acrylate, 0.07 mol of dicumyl peroxide and 3.0 g of dibutyltin oxide, were placed in a 3-liter four-necked flask. The system was then subjected to reaction at 220° C. under stirring in a nitrogen atmosphere and heating on a mantle heater, to obtain Vring copolymer (1).

The properties of the resins obtained in the above Production Examples are inclusively shown in Table 1 below.

TABLE 1

GPC and acid value data of resins

| Resins | GPC Mw ($\times 10^3$) | GPC Mn ($\times 10^3$) | GPC Mw/Mn | Acid value (mgKOH/g) | Polyester content (wt. %) |
|---|---|---|---|---|---|
| Hybrid (1) | 33.0 | 3.3 | 10.00 | 30 | 90 |
| Hybrid (2) | 3.3 | 1.7 | 1.94 | 27 | 90 |
| Hybrid (3) | 200.0 | 9.0 | 22.22 | 31 | 90 |
| Hybrid (4) | 34.0 | 3.2 | 10.63 | 7 | 70 |
| Hybrid (5) | 36.0 | 3.0 | 12.00 | 57 | 90 |
| Polyester (4) | 26.0 | 2.81 | 9.25 | 36 | 100 |
| Vinyl copolymer (1) | 25.0 | 2.3 | 10.87 | 21 | 0 |

Hydrocarbon waxes and Hydrocarbon units having properties shown in the following Tables 3 and 4, respectively, were used for Examples and Comparative Examples for toner production described hereinafter together with the resins shown in Table 1 above.

TABLE 2

Properties of Hydrocarbon waxes

| Wax | Tabs* (° C.) | Mw | Mn | Mw/Mn |
|---|---|---|---|---|
| Paraffin (A) | 75 | 520 | 450 | 1.16 |
| Paraffin (B) | 50 | 440 | 430 | 1.02 |
| Paraffin (C) | 85 | 520 | 510 | 1.90 |
| Paraffin (D) | 79 | 780 | 410 | 1.90 |
| Paraffin (E) | 77 | 680 | 580 | 1.17 |
| Ester | 72 | 660 | 450 | 1.47 |

*Tabs: Maximum heat-absorption peak temperature

TABLE 3

Properties of Hydrocarbon units

| Species | Tabs (° C.) | Mw | Mn | Mw/Mn | Density |
|---|---|---|---|---|---|
| Polyethylene (I) | 107 | 2,000 | 1,000 | 2.00 | 0.93 |
| Polypropylene | 115 | 16,000 | 900 | 17.78 | 0.94 |
| Polyethylene (II) | 95 | 2,000 | 1,000 | 2.00 | 0.93 |
| Polyethylene (III) | 105 | 2,000 | 1,000 | 2.00 | 0.91 |
| Polyethylene (IV) | 107 | 2,500 | 2,200 | 1.14 | 0.93 |

<Wax-Dispersed Master Batch>

Wax-dispersed master batch (1) used in Example 1 and some other Examples was prepared in the following manner.

First, 10 wt. parts of Polyethylene (I) shown in Table 3 was dissolved in xylene, and after replacement with nitrogen, a monomer mixture of 75 wt. parts of styrene, 10 wt. parts of acrylonitrile and 5 wt. parts of n-butyl acrylate together with di-t-butyl peroxyhexahydroterephthalate (polymerization) dissolved in xylene was added dropwise in 3 hours and polymerized at 175° C. to obtain Resin composition (1) (Mw=15,000, Mn=3,000, Mw/Mn=5.0, acid value =3.0 mgKOH/g) comprising a graft copolymer of Polyethylene (1) as the hydrocarbon unit and the resultant copolymer unit (I) partially grafted onto the hydrocarbon unit. Then, 50 wt. parts of Resin composition (1) thus obtained and 83 wt. parts of Paraffin wax (A) were melt-kneaded and pulverized into a wax-dispersed resin composition.

Further, the thus-obtained wax-dispersed resin composition and Hybrid resin (1) were melt-mixed in a weight ratio of 32:68 and pulverized to obtain Wax-dispersed master batch (1).

Example 1

Including the above-prepared Wax-dispersed master-batch (1), the following prescription of toner ingredients were provided.

| | |
|---|---|
| Binder resin: | |
| Hybrid resin (1) (D4 = 50 $\mu$m) | 83 wt. parts |
| Wax: | |
| Wax-dispersed master-batch (1) | 25 wt. parts |
| Charge control agent: | |
| Al compound (1) (di-tert-butylsalicylic acid Al compound) | 6 wt. parts |
| Pigment: | |
| Copper phthalocyanine | 5 wt. parts |

The above ingredients were sufficiently preliminarily blended by a Henschel mixer and melt-kneaded at a measured temperature of 130° C. through a twin-screw extruder. After being cooled, the melt-kneaded product was crushed to ca. 1–2 mm by a hammer mill and then finely pulverized by an air-jet pulverizer, followed by strict removal of fine and coarse powder fractions by a multi-division pneumatic classifier to obtain cyan color toner particles having a weight-average particle size (D4) of 7.8 $\mu$m.

100 wt. parts of the toner particles were blended with externally added 1.5 wt. parts of titanium oxide particles surface-treated with isobutyltrimethoxysilane and having a primary particle size of 50 nm, to obtain Cyan toner 1. As a result of the GPC measurement of the THF-soluble content, Cyan toner 1 provided a GPC chart shown in FIG. 3 indicating the presence of a high-molecular weight component (i.e., a shift from the base line around an elution time of 50 min. or shorter).

As a result of the viscoelasticity measurement, Cyan toner 1 exhibited a dynamic modulus at 80° C. ($G'_{80}$) of $5.2\times10^5$ N/m$^2$, a loss tangent (tan $\delta$=G'/G", i.e., a ratio of loss modulus (G") to elastic modulus (G'), which assured a minimum (tan $\delta_{min}$) of 0.73 in a temperature range of 120–180° C. and a value at 180° C. (tan $\delta_{180}$) of 1.10 giving a ratio (tan $\delta_{180}$/tan $\delta_{min}$) of 1.51. Further, in the temperature range of 120–180° C., the dynamic modulus ($G'_{120-180}$) assumed a maximum of $1.3\times10^4$ N/m$^2$ and a minimum of $3.4\times10^3$ N/m$^2$.

Examples 2–30 and Comparative Examples 1–4

Cyan toners were prepared by changing the various components, inclusive of the binder resin (the species, and resin particle size but the content was 100 wt. parts in each Example), the hydrocarbon wax (the species and content), the wax-dispersion agent (the species and content of the copolymer unit and hydrocarbon unit therefor), and the organometallic compound (the species and content), otherwise, basically the same manner as in Example 1 described above.

The manners of modification in respective Examples are summarized in Table 4 and supplemented below.

Examples 2–3

Cyan toners 2 and 3 were prepared in the same manner as in Example 1 except that the amount of Al compound (I) as the organometallic compound was increased to 9.4 wt. parts (Example 2) and decreased to 0.3 wt. part (Example 3), respectively.

Example 4

Cyan toner 4 was prepared in the same manner as in Example 1 except for raising the melt-kneading temperature at the twin-screw extruder to 150° C.

Example 5

Cyan toner 5 was prepared in the same manner as in Example 1 except for increasing the amount of Al compound (I) to 9.4 wt. parts and raising the melt-kneading temperature at the twin-screw extruder to 170

Example 6

Cyan toner 6 was prepared in the same manner as in Example 1 except for reducing the average particle size (D4) of Hybrid resin (1) to 30 $\mu$m.

Example 7

Cyan toner 7 was prepared in the same manner as in Example 1 except for using Cr compound (I) (di-tert-butylsalicylic acid Cr compound) instead of Al compound (I) as the organometallic compound.

Examples 8 to 11

Cyan toners 8 to 11 were prepared in the same manner as in Example 1 except for using Hybrid resins (2) to (5) shown in Table 1, respectively, instead of Hybrid resin (1).

Examples 12 and 13

Cyan toners 12 and 13 were prepared in the same manner as in Example 1 except for decreasing and increasing the amount of Paraffin wax (A).

Examples 14 to 17

Cyan toners 14 to 17 were prepared in the same manner as in Example 1 except for using Paraffin waxes (B) to (E) shown in Table 2, respectively, instead of Paraffin wax (A).

Examples 18 and 19

Cyan toners 18 and 19 were prepared in the same manner as in Example 1 except for decreasing and increasing the amount of Polyethylene (I) as the hydrocarbon unit for constituting the wax-dispersing agent.

Examples 20 to 23

Cyan toners 20 to 23 were prepared in the same manner as in Example 1 except for using Polypropylene or Polyethylene (II) to (IV), respectively, shown in Table 3 instead of Polyethylene (I) for providing the wax-dispersing agent.

Examples 24 and 25

Cyan toners 24 and 25 were prepared in the same manner as in Example 1 except for decreasing and increasing the amount of Copolymer unit (I) for providing the wax-dispersing agent.

Example 26

Cyan toner 26 was prepared in the same manner as in Example 1 except for using a dry blend of Polyester (1) and Vinyl copolymer shown in Table 1 in a weight ratio of 90:10 instead of Hybrid resin (1) as the binder resin.

Example 27

Cyan toner 27 was prepared in the same manner as in Example 1 except for increasing the amount of Al compound (I).

Example 28

Cyan toner 28 was prepared in the same manner as in Example 1 except for increasing the amount of Paraffin wax (A).

Example 29

Cyan toner 29 was prepared in the same manner as in Example 1 except for using Copolymer unit (II) (styrene-2-ethylhexyl acrylate copolymer, Mw=115000, Mn=4700) prepared by using a monomer mixture of 85 wt. parts of styrene and 5 wt. parts of 2-ethylhexyl acrylate instead of Copolymer unit (I) (styrene-acrylonitrile-butyl acrylate terpolymer) for providing the wax-dispersing agent.

Example 30

Cyan toner 30 was prepared in the same manner as in Example 1 except for using Polyester resin (1) shown in Table 1 instead of Hybrid resin (1).

Comparative Example 1

Cyan toner 31 was prepared in the same manner as in Example 1 except for omitting Al compound (I).

Comparative Example 2

Cyan toner 32 was prepared in the same manner as in Example 1 except for omitting Paraffin wax (A).

Comparative Example 3

Cyan toner 33 was prepared in the same manner as in Example 1 except for using Ester wax shown in Table 2 instead of Paraffin wax (A).

Comparative Example 4

Cyan toner 34 was prepared in the same manner as in Example 1 except for omitting Copolymer unit (I) for providing the wax dispersing agent.

Each of the above-prepared Cyan toners 1 to 34 was blended with magnetic ferrite particles surface-coated with silicone resin ($D_{50}$ (50 wt. %-cumulative particle size)=50 μm) to provide a cyan developer (of the two-component type) having a toner concentration of 6 wt. %.

Each cyan developer of the two-component type prepared above was evaluated with respect to the following items and the results of the evaluation are inclusively shown in Table 5 appearing hereinafter.

<Fixing Performances>

For evaluating Fixing initiation temperature (TFI) and Fixable temperature range (Tfix range), the above-prepared two-component type cyan developer was introduced in a commercially available plain paper full-color copying machine ("CLC700", made by Canon K.K.) from which the fixing unit had been removed, and subjected to formation of yet-unfixed toner images according to a single color-mode in a normal temperature/normal humidity environment (23° C./60% RH). The yet-unfixed toner images were subjected to fixation by using a fixing test having an organization as illustrated in FIG. 6 without oil application at a process speed of 150 mm/sec at fixing temperatures which were increased from 115° C. by an increment of 5° C. each. The fixed images were evaluated in the following manner.

Fixed solid toner images (initially formed at a toner coverage of 1.2 mg/cm$^2$) formed on plain paper (of 64 g/m$^2$) at various fixing temperatures were folded so that each toner image was placed outside. A lowest temperature giving a folded toner image free from toner image peeling was taken as a fixing initiation temperature ($T_{FI}$ (° C.)). The fixed toner images were observed with eyes to find a highest temperature free from high-temperature offset as an upper limit temperature ($T_H$), and a difference ($T_H$–$T_{FI}$) was recorded as a fixable temperature range (Tfix range).

Color-mixing temperature range (Tmix.range) was determined as a temperature range giving a reflectance exceeding 7% as measured at an incidence angle of 60 deg. according to the following gloss measurement with respect to fixed solid image (initially formed at a toner coverage of 1.2 kg/cm$^2$).

The gloss measurement was performed by using a gloss meter ("VG-10", made by Nippon Denshoku K.K.). For the measurement, an input voltage is set at 6 volts by a constant voltage supply, and the light projecting and receiving angles (incidence and exit angles) are respectively set at 60 deg. After a standard adjustment by using a 0 adjuster and a standard plate, a fixed sample image as mentioned above is placed on the sample stand and three sheets of white paper are inserted between the fixed sample image and the stand. A % value shown at the indicator is recorded while the S-S/10 selector switch is set to S and the angle-sensitively selector switch is set to 45–60.

For evaluating OHP transmittance ($T_{OHP}$ (%)), a yet-unfixed solid toner image at a toner coverage of 0.6 mg/cm$^2$ was formed on an OHP film and subjected to fixation at 180° C. and a process speed of 70 mm/sec by using a fixing tester having a structure shown in FIG. 6 without oil application to form a sample OHP transparency for transmittance measurement.

The OHP transmittance measurement was performed by using an automatic recording spectrophotometer ("UV 2200", made by Shimadzu Seisakusho K.K.) to measure a transmittance through a fixed toner image on an OHP film at a maximum absorption wavelength of 500 nm for a cyan toner (in contrast with 650 nm for a magenta toner and 600 nm for a yellow toner) relative to the transmittance of the blank OHP film (=100%).

<Storage Stability (Storage)>

A sample toner was placed in an oven at 50° C. (for 1 week). Based on the degree of agglomeration according to eye observation, the evaluation was performed according to the following standard:

A: No agglomerate was observed at all, and the sample exhibited very good flowability.

B: Substantially no agglomerate, and good flowability.

C: Some agglomerate was observed but could be disintegrated easily.

D: Agglomerate was formed but could be disintegrated by a developer stirring device.

E: Agglomerate formed was not sufficiently disintegrated by a developer stirring device.

<Image-Forming Performances>

Each two-component cyan developer was subjected continuous image formation on 10,000 sheets each in environments of low temperature/low humidity (15° C./10% RH) and high temperature/high humidity (30° C./85% RH) by using a color copying machine ("CLC-700", made by Canon K.K.) for reproducing an original having an image area percentage of 25%.

Triboelectric charge (Otribo) of each developer sample was measured with respect to a developer before use and a developer taken out of the developing device after the continuous image formation of 10,000 sheets, each having a toner concentration of 6 wt. %.

Figure 7:
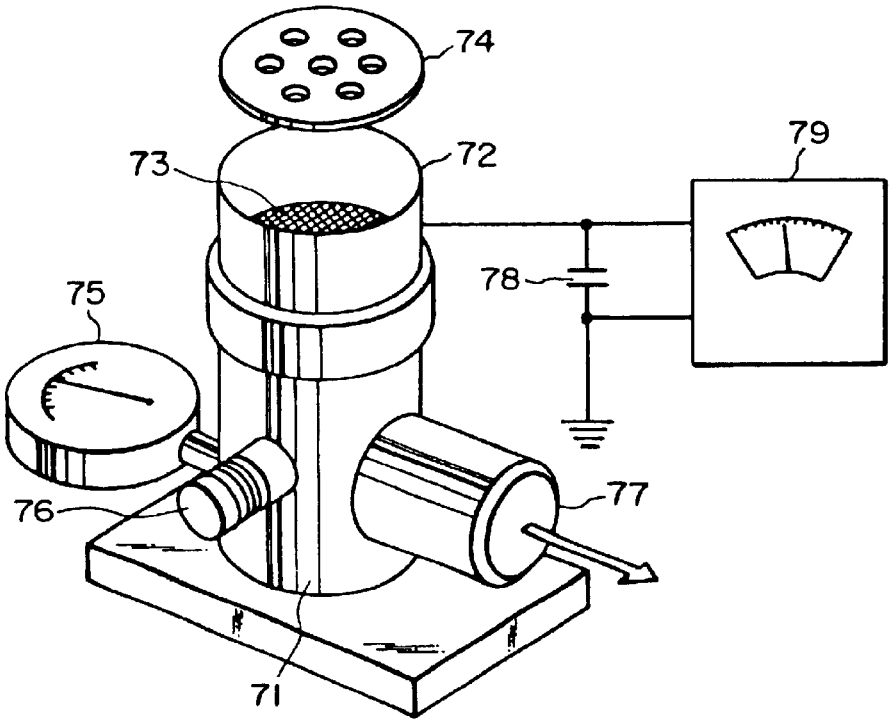
FIG. 7 is a perspective illustration of a device for measuring a chargeability of a toner or an external additive.

FIG. 7 is an illustration of an apparatus for measuring a toner triboelectric charge. A developer sample provided in the above-described manner in a weight of ca. 0.5–1.5 g, is placed in a metal measurement vessel 72 bottomed with a 500-mesh screen 73 having an opening of 32 $\mu$m and then covered with a metal lid 74. The weight of the entire measurement vessel 72 at this time is weighed at $W_1$ (g). Then, an aspirator 71 (composed of an insulating material at least with respect to a portion contacting the measurement vessel 72) is operated to suck the toner through a suction port 77 while adjusting a gas flow control valve 76 to provide a pressure of 250 mmAq at a vacuum gauge 75. Under this state, the toner is sufficiently removed by sucking, preferably for 2 min.

The potential reading on a potentiometer 79 at this time is denoted by V (volts) while the capacitance of a capacitor 78 is denoted by C (mF), and the weight of the entire measurement vessel is weighed at $W_2$ (g). Then, the triboelectric charge Qtribo (mC/kg) of the sample toner is calculated by the following equation:

$$Qtribo(mC/kg)=C\times V/(W_1-W_2).$$

Developing performance (Image) was evaluated for images formed at the initial stage and the final stage of the continuous image formation with respect the presence or absence of white dropout, fog and rough images. The evaluation was performed at the following three levels.

A: Very excellent image

B: Acceptable image

C: Inferior image

Image density (I.D.) was measured by forming a solid image before and after the continuous image formation and measuring reflection image densities at five points of the solid image by a Macbeth densitometer (made by Macbeth Co.) to determine an average of the 5 measured values as a measured image density (I.D.).

The results of the above evaluation for all Cyan toners and Cyan developers of Examples and Comparative Examples are inclusively shown in Table 5.

With reference to Tables 4 and 5, the following comments are supplemented as notable matters with respect to some Examples and Comparative Examples.

Examples 2 and 3

Toner 2 with an increased Al compound (I) resulted in an increase in high-molecular weight component (Table 4) and a shift of fixable temperature region to a higher temperature side (Table 5), while Toner 3 with a decrease Al compound (I) shifted the fixable temperature region to a lower temperature side (Table 5).

Example 5

Toner 5 obtained through melt-kneading at a higher temperature exhibited a tendency of increasing the high molecular weight component (Table 4).

Example 6

Toner 6 obtained through the use of Hybrid resin (1) in a small particle size as a toner ingredient exhibited a broader fixable temperature range (Tfix range) presumably due to promotion of the dispersion of Al compound (I) and the crosslinkage (Tables 4 and 5).

Examples 8 to 11

Toner 9 obtained by using Hybrid resin (3) of a higher molecular weight resulted in a higher anti-high-temperature offset property while somewhat lowering the color mixability.

Examples 12 and 13

Toner 13 obtained by using an increased amount of Paraffin wax (A) resulted in slightly lower OHP transmittance ($T_{OHP}$) and developing performance.

Examples 14 to 17

Use of Waxes (B) to (E) having different melting points Tabs (as shown in Table 2) resulted in different fixing initiation temperatures ($T_{FI}$) due to changes in wax exudation temperatures.

Examples 18 and 19

Toner 19 obtained by using an increased amount of Polyethylene (I) as the hydrocarbon unit for providing the wax-dispersing agent, somewhat retarded the wax exudation to slightly lower the fixing performances.

Examples 24 and 25

Toner 24 obtained by using a decreased amount of Copolymer unit (I) for providing the wax-dispersing agent tended to result in a larger wax dispersion size favoring the fixing performances but slightly lowering the developing performance. Toner 25 obtained by using an increased amount of Copolymer unit (I) tended to promote fine dispersion of wax particles and retard the wax exudation.

Example 26

Toner 26 obtained by using a 90:10-dry blend of Polyester (1) and Ving copolymer (1) instead of Hybrid resin (1) as the binder resin resulted in somewhat lower wax dispersibility and somewhat lower developing performance.

Example 27

Toner 27 obtained by using a further increased amount of Al compound (I) compared with Toner 2 tended to cause further crosslinkage and exhibit a higher $T_{FI}$ (° C.), a narrower Tmix range and a higher chargeability leading to an excessive charge in the continuous image formation.

Comparative Example 1

Figure 3:
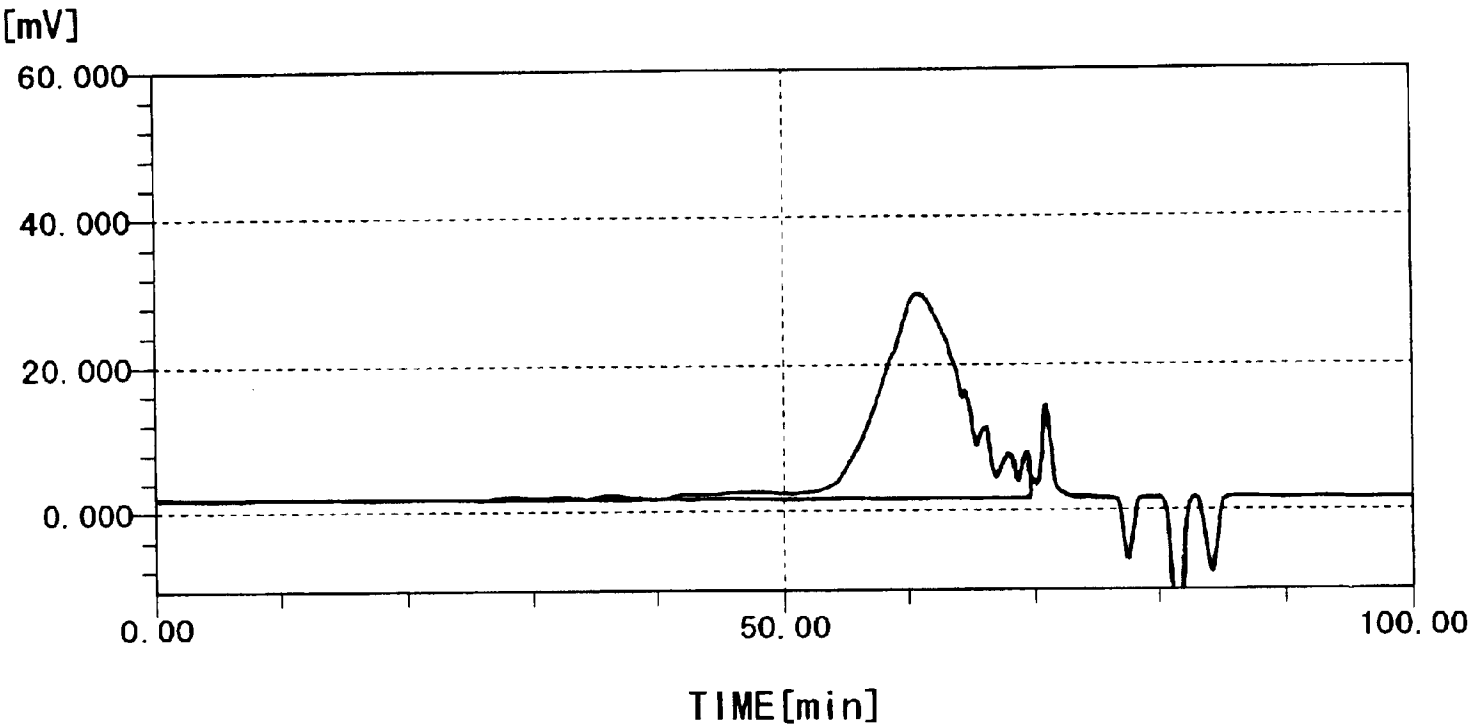
FIGS. 3 and 4 show GPC (gel permeation chromatography) charts of Cyan toner 1 (Example 1) and Cyan toner 26 (Example 26), respectively.
Figure 4:
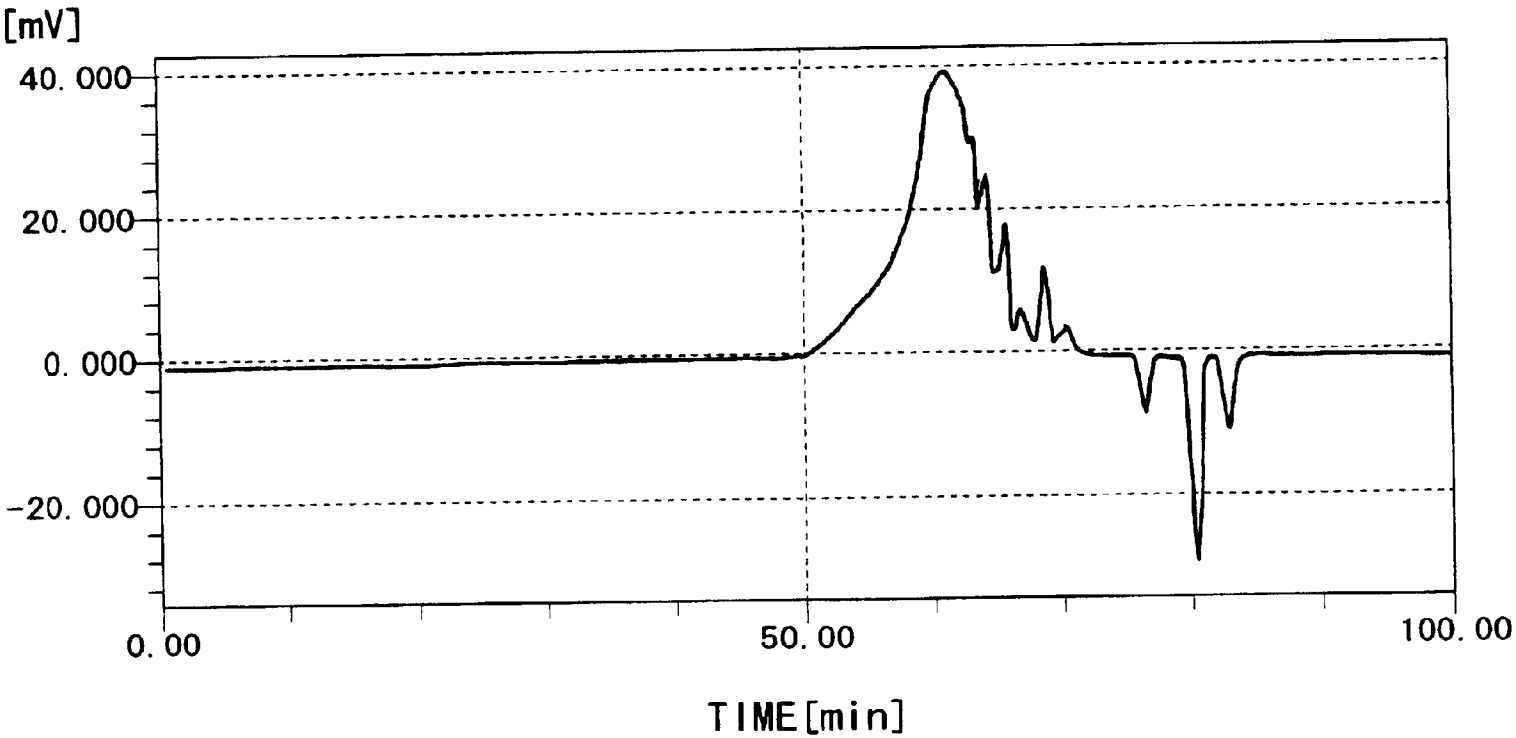

Toner 31 obtained while omitting Al compound (I) provided a GPC chart shown in FIG. 4, which failed to show the presence of a high molecular weight component caused by crosslinkage around an elution time of 50 min. or less as observed in FIG. 3 for Toner 1 of Example 1. As a result, Toner 31 failed to exhibit adequate fixable temperature range due to high-temperature offset and also poor storage stability.

Comparative Example 4

Toner 34 obtained while omitting Copolymer unit (I) for the wax dispersing agent exhibited quite inferior continuous image forming performances due to inferior dispersion of a large amount of paraffin wax added thereto.

TABLE 4

| | | Toner composition | | | | | | |
|---|---|---|---|---|---|---|---|---|
| | | Binder resin | | | Hydrocarbon wax | | Wax-dispersing agent Copolymer unit | |
| Example | Toner | Species | Polyester Cont. (wt %) | Size (μm) | Species | Content (wt. parts) | Species | Content (wt. parts) |
| 1 | 1 | Hybrid (1) | 90 | 50 | Paraffin (A) | 5.0 | (I) | 2.70 |
| 2 | 2 | Hybrid (1) | 90 | 50 | Paraffin (A) | 5.0 | (I) | 2.70 |
| 3 | 3 | Hybrid (1) | 90 | 50 | Paraffin (A) | 5.0 | (I) | 2.70 |
| 4 | 4 | Hybrid (1) | 90 | 50 | Paraffin (A) | 5.0 | (I) | 2.70 |
| 5 | 5 | Hybrid (1) | 90 | 50 | Paraffin (A) | 5.0 | (I) | 2.70 |
| 6 | 6 | Hybrid (1) | 90 | 30 | Paraffin (A) | 5.0 | (I) | 2.70 |
| 7 | 7 | Hybrid (1) | 90 | 50 | Paraffin (A) | 5.0 | (I) | 2.70 |
| 8 | 8 | Hybrid (2) | 90 | 50 | Paraffin (A) | 5.0 | (I) | 2.70 |
| 9 | 9 | Hybrid (3) | 90 | 50 | Paraffin (A) | 5.0 | (I) | 2.70 |
| 10 | 10 | Hybrid (4) | 70 | 50 | Paraffin (A) | 5.0 | (I) | 2.70 |
| 11 | 11 | Hybrid (5) | 90 | 50 | Paraffin (A) | 5.0 | (I) | 2.70 |
| 12 | 12 | Hybrid (1) | 90 | 50 | Paraffin (A) | 0.2 | (I) | 2.70 |
| 13 | 13 | Hybrid (1) | 90 | 50 | Paraffin (A) | 9.7 | (I) | 2.70 |
| 14 | 14 | Hybrid (1) | 90 | 50 | Paraffin (B) | 5.0 | (I) | 2.70 |
| 15 | 15 | Hybrid (1) | 90 | 50 | Paraffin (C) | 5.0 | (I) | 2.70 |
| 16 | 16 | Hybrid (1) | 90 | 50 | Paraffin (D) | 5.0 | (I) | 2.70 |
| 17 | 17 | Hybrid (1) | 90 | 50 | Paraffin (E) | 5.0 | (I) | 2.70 |
| 18 | 18 | Hybrid (1) | 90 | 50 | Paraffin (A) | 5.0 | (I) | 2.70 |
| 19 | 19 | Hybrid (1) | 90 | 50 | Paraffin (A) | 5.0 | (I) | 2.70 |
| 20 | 20 | Hybrid (1) | 90 | 50 | Paraffin (A) | 5.0 | (I) | 2.70 |
| 21 | 21 | Hybrid (1) | 90 | 50 | Paraffin (A) | 5.0 | (I) | 2.70 |
| 22 | 22 | Hybrid (1) | 90 | 50 | Paraffin (A) | 5.0 | (I) | 2.70 |
| 23 | 23 | Hybrid (1) | 90 | 50 | Paraffin (A) | 5.0 | (I) | 2.70 |
| 24 | 24 | Hybrid (1) | 90 | 50 | Paraffin (A) | 5.0 | (I) | 0.20 |
| 25 | 25 | Hybrid (1) | 90 | 50 | Paraffin (A) | 5.0 | (I) | 18.00 |
| 26 | 26 | Polyester(1) + Vinyl copolymer(1) | 90 | 50 | Paraffin (A) | 5.0 | (I) | 2.70 |
| 27 | 27 | Hybrid (1) | 90 | 50 | Paraffin (A) | 5.0 | (I) | 2.70 |
| 28 | 28 | Hybrid (1) | 90 | 50 | Paraffin (A) | 11.0 | (I) | 2.70 |
| 29 | 29 | Hybrid (1) | 90 | 50 | Paraffin (A) | 5.0 | (II) | 2.70 |

TABLE 4-continued

| | | | | | | | | |
|---|---|---|---|---|---|---|---|---|
| 30 | 30 | Polyester (1) | 100 | 50 | Paraffin (A) | 5.0 | (I) | 2.70 |
| Comp.1 | 31 | Hybrid (1) | 90 | 50 | Paraffin (A) | 5.0 | (I) | 2.70 |
| Comp.2 | 32 | Hybrid (1) | 90 | 50 | — | — | (I) | 2.70 |
| Comp.3 | 33 | Hybrid (1) | 90 | 50 | Ester | 5.0 | (I) | 2.70 |
| Comp.4 | 34 | Hybrid (1) | 90 | 50 | Paraffin (A) | 5.0 | — | — |

| | Wax-dispersing agent Hydrocarbon unit | | Organometallic Compound | | | | | Kneading |
|---|---|---|---|---|---|---|---|---|
| | | Content | | Content | Molecular weight | | | temp |
| Example | Species | (wt. parts) | Species | (wt. parts) | Mw | Mn | Mw/Mn | (° C.) |
| 1 | Polyethylene (I) | 0.30 | Al (I) | 6.0 | 3,118,500 | 3,600 | 866 | 130 |
| 2 | Polyethylene (I) | 0.30 | Al (I) | 9.4 | 6,159,700 | 2,860 | 2,154 | 130 |
| 3 | Polyethylene (I) | 0.30 | Al (I) | 0.3 | 316,400 | 3,100 | 102 | 130 |
| 4 | Polyethylene (I) | 0.30 | Al (I) | 6.0 | 3,731,800 | 2,950 | 1,265 | 150 |
| 5 | Polyethylene (I) | 0.30 | Al (I) | 9.4 | 8,452,400 | 3,400 | 2,486 | 170 |
| 6 | Polyethylene (I) | 0.30 | Al (I) | 6.0 | 337,000 | 1,690 | 199 | 130 |
| 7 | Polyethylene (I) | 0.30 | Cr (I) | 6.0 | 4,429,200 | 3,260 | 1,359 | 130 |
| 8 | Polyethylene (I) | 0.30 | Al (I) | 6.0 | 3,006,000 | 1,680 | 1,789 | 130 |
| 9 | Polyethylene (I) | 0.30 | Al (I) | 6.0 | 19,360,000 | 9,710 | 1,994 | 130 |
| 10 | Polyethylene (I) | 0.30 | Al (I) | 6.0 | 3,480,000 | 3,260 | 1,067 | 130 |
| 11 | Polyethylene (I) | 0.30 | Al (I) | 6.0 | 3,680,000 | 3,020 | 1,219 | 130 |
| 12 | Polyethylene (I) | 0.30 | Al (I) | 6.0 | 3,480,000 | 3,420 | 1,018 | 130 |
| 13 | Polyethylene (I) | 0.30 | Al (I) | 6.0 | 3,710,000 | 3,160 | 1,174 | 130 |
| 14 | Polyethylene (I) | 0.30 | Al (I) | 6.0 | 3,480,000 | 3,520 | 989 | 130 |
| 15 | Polyethylene (I) | 0.30 | Al (I) | 6.0 | 3,560,000 | 3,490 | 1,020 | 130 |
| 16 | Polyethylene (I) | 0.30 | Al (I) | 6.0 | 3,390,000 | 3,390 | 1,000 | 130 |
| 17 | Polyethylene (I) | 0.30 | Al (I) | 6.0 | 3,890,000 | 3,410 | 1,141 | 130 |
| 18 | Polyethylene (I) | 0.15 | Al (I) | 6.0 | 4,890,000 | 3,510 | 1,393 | 130 |
| 19 | Polyethylene (I) | 1.90 | Al (I) | 6.0 | 4,950,000 | 3,610 | 1,371 | 130 |
| 20 | Polypropylene | 0.30 | Al (I) | 6.0 | 3,980,000 | 3,450 | 1,154 | 130 |
| 21 | Polyethylene (II) | 0.30 | Al (I) | 6.0 | 4,010,000 | 3,330 | 1,204 | 130 |
| 22 | Polyethylene (III) | 0.30 | Al (I) | 6.0 | 3,650,000 | 3,500 | 1,043 | 130 |
| 23 | Polyethylene (IV) | 0.30 | Al (I) | 6.0 | 3,990,000 | 3,560 | 1,121 | 130 |
| 24 | Polyethylene (I) | 0.30 | Al (I) | 6.0 | 3,380,000 | 3,100 | 1,090 | 130 |
| 25 | Polyethylene (I) | 0.30 | Al (I) | 6.0 | 5,950,000 | 3,410 | 1,745 | 130 |
| 26 | Polyethylene (I) | 0.30 | Al (I) | 6.0 | 2,647,000 | 3,020 | 876 | 130 |
| 27 | Polyethylene (I) | 0.30 | Al (I) | 11.0 | 9,750,000 | 2,600 | 3,750 | 130 |
| 28 | Polyethylene (I) | 0.30 | Al (I) | 6.0 | 3,215,200 | 3,021 | 1,064 | 130 |
| 29 | Polyethylene (I) | 0.30 | Al (I) | 6.0 | 3,562,000 | 3,460 | 1,029 | 130 |
| 30 | Polyethylene (I) | 0.30 | Al (I) | 6.0 | 4,015,000 | 3,550 | 1,131 | 130 |

TABLE 4-continued

| | | | | | | | | |
|---|---|---|---|---|---|---|---|---|
| Comp.1 | Polyethylene (I) | 0.30 | — | — | 20,030 | 3,265 | 6 | 130 |
| Comp.2 | Polyethylene (I) | 0.30 | Al (I) | 6.0 | 3,682,000 | 3,562 | 1,034 | 130 |
| Comp.3 | Polyethylene (I) | 0.30 | Al (I) | 6.0 | 3,156,000 | 3,254 | 970 | 130 |
| Comp.4 | Polyethylene (I) | 0.30 | Al (I) | 6.0 | 3,012,000 | 3,425 | 879 | 130 |

TABLE 5

| | | Performance evaluation results | | | | |
|---|---|---|---|---|---|---|
| | | Fixing performances | | | | Sotorage |
| Example | Toner | $T_{FI}$ (° C.) | $T_{fix}$ range (deg.) | $T_{mix}$ range (deg.) | $T_{OHP}$ (%) | 50° C./ 7 days |
| 1 | 1 | 140 | 60 | 30 | 86 | A |
| 2 | 2 | 155 | 50 | 30 | 80 | A |
| 3 | 3 | 130 | 55 | 45 | 90 | A |
| 4 | 4 | 130 | 50 | 30 | 81 | A |
| 5 | 5 | 150 | 55 | 30 | 80 | A |
| 6 | 6 | 140 | 60 | 40 | 82 | A |
| 7 | 7 | 130 | 50 | 45 | 79 | A |
| 8 | 8 | 130 | 50 | 30 | 86 | A |
| 9 | 9 | 155 | 60 | 30 | 79 | A |
| 10 | 10 | 130 | 50 | 40 | 81 | A |
| 11 | 11 | 130 | 55 | 35 | 84 | A |
| 12 | 12 | 130 | 45 | 30 | 86 | A |
| 13 | 13 | 140 | 65 | 35 | 80 | A |
| 14 | 14 | 130 | 60 | 40 | 89 | A |
| 15 | 15 | 150 | 50 | 30 | 90 | A |
| 16 | 16 | 140 | 50 | 35 | 81 | B |
| 17 | 17 | 130 | 50 | 40 | 83 | A |
| 18 | 18 | 130 | 60 | 30 | 87 | A |
| 19 | 19 | 140 | 55 | 30 | 87 | A |
| 20 | 20 | 130 | 60 | 35 | 86 | A |
| 21 | 21 | 150 | 50 | 40 | 85 | B |
| 22 | 22 | 130 | 55 | 30 | 82 | A |
| 23 | 23 | 140 | 50 | 35 | 84 | B |
| 24 | 24 | 140 | 60 | 30 | 84 | A |
| 25 | 25 | 130 | 60 | 40 | 81 | B |
| 26 | 26 | 130 | 45 | 40 | 81 | B |
| 27 | 27 | 130 | 70 | 30 | 73 | A |
| 28 | 28 | 130 | 65 | 35 | 74 | B |
| 29 | 29 | 140 | 60 | 30 | 74 | A |
| 30 | 30 | 130 | 60 | 45 | 92 | A |
| Comp. 1 | 31 | None | — | — | — | E |
| Comp. 2 | 32 | None | — | — | — | B |
| Comp. 3 | 33 | None | — | — | — | C |
| Comp. 4 | 34 | 150 | 40 | 30 | 80 | B |

| | 15° C./10% RH | | | | | | 30° C./85% RH | | | | | |
|---|---|---|---|---|---|---|---|---|---|---|---|---|
| | Initial | | | After 10000 sheets | | | Initial | | | After 10000 sheets | | |
| Example | $Q_{tribo}$ (μC/g) | Image | I.D. | $Q_{tribo}$ (μC/g) | Image | I.D. | $Q_{tribo}$ (μC/g) | Image | I.D. | $Q_{tribo}$ (μC/g) | Image | I.D. |
| 1 | −22.8 | A | 1.70 | −28.3 | A | 1.82 | −24.6 | A | 1.79 | −26.9 | A | 1.80 |
| 2 | −26.9 | A | 1.67 | −29.7 | A | 1.61 | −26.9 | A | 1.75 | −26.5 | A | 1.74 |
| 3 | −21.1 | A | 1.71 | −21.4 | A | 1.82 | −20.4 | A | 1.84 | −20.1 | A | 1.82 |
| 4 | −25.4 | A | 1.71 | −23.6 | A | 1.84 | −26.8 | A | 1.72 | −21.3 | A | 1.82 |
| 5 | −26.9 | A | 1.74 | −28.3 | A | 1.63 | −24.6 | A | 1.84 | −24.8 | A | 1.63 |
| 6 | −23.5 | A | 1.63 | −23.5 | A | 1.78 | −21.3 | A | 1.84 | −25.6 | A | 1.78 |
| 7 | −26.0 | A | 1.78 | −23.5 | A | 1.80 | −28.3 | A | 1.63 | −24.7 | A | 1.80 |
| 8 | −25.6 | A | 1.80 | −21.9 | A | 1.78 | −24.8 | A | 1.78 | −24.6 | A | 1.78 |
| 9 | −24.8 | A | 1.78 | −25.6 | A | 1.80 | −25.6 | A | 1.80 | −28.3 | A | 1.74 |
| 10 | −25.6 | A | 1.80 | −25.6 | A | 1.82 | −24.7 | A | 1.74 | −26.4 | A | 1.76 |
| 11 | −24.7 | A | 1.74 | −25.4 | A | 1.74 | −22.8 | A | 1.82 | −25.4 | A | 1.80 |
| 12 | −24.6 | A | 1.76 | −24.8 | A | 1.82 | −21.3 | A | 1.82 | −26.1 | A | 1.84 |
| 13 | −27.1 | A | 1.79 | −22.0 | A | 1.82 | −23.6 | A | 1.84 | −20.4 | A | 1.63 |
| 14 | −27.0 | A | 1.82 | −23.1 | A | 1.84 | −26.1 | A | 1.84 | −23.5 | A | 1.76 |
| 15 | −26.8 | A | 1.84 | −26.1 | A | 1.86 | −24.7 | A | 1.82 | −23.5 | B | 1.84 |
| 16 | −24.6 | A | 1.75 | −25.4 | A | 1.76 | −25.4 | A | 1.84 | −21.9 | A | 1.86 |

TABLE 5-continued

| | | | | | | | | | | | | |
|---|---|---|---|---|---|---|---|---|---|---|---|---|
| 17 | −21.3 | A | 1.82 | −28.3 | A | 1.82 | −23.5 | A | 1.84 | −25.6 | A | 1.84 |
| 18 | −28.3 | A | 1.76 | −26.0 | B | 1.76 | −25.4 | A | 1.75 | −23.5 | A | 1.84 |
| 19 | −26.4 | A | 1.84 | −25.6 | A | 1.71 | −23.5 | A | 1.78 | −25.6 | A | 1.72 |
| 20 | −25.6 | A | 1.86 | −24.8 | A | 1.74 | −26.1 | A | 1.80 | −24.8 | A | 1.74 |
| 21 | −24.7 | A | 1.84 | −25.6 | B | 1.74 | −21.9 | A | 1.78 | −24.8 | B | 1.74 |
| 22 | −25.4 | A | 1.85 | −25.7 | A | 1.71 | −22.8 | A | 1.80 | −25.6 | A | 1.71 |
| 23 | −23.5 | A | 1.79 | −24.6 | A | 1.84 | −21.3 | A | 1.78 | −23.1 | B | 1.74 |
| 24 | −26.1 | A | 1.76 | −23.1 | A | 1.84 | −23.6 | A | 1.80 | −27.0 | A | 1.63 |
| 25 | −21.9 | A | 1.74 | −24.7 | B | 1.72 | −24.6 | A | 1.71 | −26.8 | A | 1.78 |
| 26 | −19.9 | A | 1.74 | −18.6 | B | 1.72 | −18.4 | B | 1.71 | −17.2 | A | 1.74 |
| 27 | −36.2 | B | 1.65 | −26.4 | B | 1.79 | −25.3 | B | 1.82 | −21.3 | B | 1.74 |
| 28 | −18.6 | B | 1.90 | −17.5 | B | 1.84 | −16.3 | B | 1.78 | −15.2 | B | 1.80 |
| 29 | −24.1 | A | 1.73 | −19.0 | A | 1.82 | −20.4 | A | 1.80 | −17.8 | B | 1.87 |
| 30 | −26.9 | A | 1.70 | −22.3 | A | 1.84 | −21.5 | A | 1.85 | −20.3 | A | 1.88 |
| Comp. 1 | Evaluation was impossible due to fixation failure. | | | | | | | | | | | |
| Comp. 2 | | | | | | | | | | | | |
| Comp. 3 | | | | | | | | | | | | |
| Comp. 4 | −13.2 | B | 1.82 | −10.4 | C | N.M.* | −20.3 | B | 1.84 | 10000 sheets failed | | |

*N.M. = not measurable because of poor image

What is claimed is:

1. A toner comprising: (i) a binder resin, (ii) a colorant, (iii) a hydrocarbon wax, (iv) a resin composition comprising at least a copolymer unit synthesized by reaction of a styrenic monomer with at least one monomer selected from the group consisting of nitrogen-containing vinyl monomers, carboxyl group-containing monomers, hydroxyl group-containing monomers, acrylate ester monomers and methacrylate ester monomers, and a hydrocarbon unit; and (v) an organometallic compound;

wherein the binder resin (i) comprises a polyester component in a proportion of at least 60 wt. % of the binder resin (i), and the toner has a molecular weight distribution as measured by gel permeation chromatography (GPC) including a weight-average molecular weight (Mw) of at least $4.0\times10^4$ and a ratio Mw/Mn of at least 50 between the weight-average molecular weight (Mw) and a number-average molecular weight (Mn).

2. The toner according to claim 1, wherein the binder resin (i) contains 65–95 wt. % of the polyester component, at least a portion of which is chemically bonded to a vinyl polymer.

3. The toner according to claim 1, wherein the toner has an Mw of $4.0\times10^4$–$1.0\times10^7$, and an Mn of $1.5\times10^3$–$1.0\times10^4$.

4. The toner according to claim 1, wherein the copolymer unit in the resin composition (iv) comprises a terpolymer of a styrenic monomer, a nitrogen-containing vinyl monomer and a (meth)acrylate ester monomer.

5. The toner according to claim 1, wherein the hydrocarbon wax (iii) exhibits a maximum heat-absorption peak temperature in a range of 55–80° C. on a heat-absorption curve on temperature increase as measured by differential scanning calorimetry (DSC).

6. The toner according to claim 1, wherein the hydrocarbon wax (iii) exhibits a GPC molecular weight distribution including an Mw of 400–800, an Mn of 400–600 and an Mw/Mn ratio of 1.0–2.0.

7. The toner according to claim 1, wherein the hydrocarbon wax (iii) is contained in an amount of 0.1–6 wt. parts per 100 wt. parts of the binder resin.

8. The toner according to claim 1, wherein the copolymer unit in the resin composition (iv) is contained in an amount of 0.1–20 wt. parts per 100 wt. parts of the binder resin.

9. The toner according to claim 1, wherein the hydrocarbon unit in the resin composition (iv) exhibits a maximum heat-absorption peak temperature in a range of 90–130° C. on a DSC heat-absorption curve on temperature increase.

10. The toner according to claim 1, wherein the hydrocarbon unit in the resin composition (iv) exhibits a GPC molecular weight distribution including an Mw of 500–30,000, an Mn of 500–3,000, and an Mw/Mn ratio of 1.0–20, and also has a density of 0.90–0.95.

11. The toner according to claim 1, wherein the hydrocarbon unit is contained in an amount of 0.1–2 wt. parts per 100 wt. parts of the binder resin.

12. The toner according to claim 1, wherein the organometallic compound (iv) is a metal compound of an aromatic oxycarboxylic acid or a metal compound of an aromatic alkoxycarboxylic acid.

13. The toner according to claim 1, wherein the organometallic compound (iv) is contained in an amount of 0.1–10 wt. parts per 100 wt. parts of the binder resin.

14. The toner according to claim 1, wherein the binder resin (i) exhibits a GPC molecular weight distribution including an Mw of $2.6\times10^3$–$1.9\times10^5$, an Mn of 1300–9500, and an Mw/Mn ratio of 2–20.

15. The toner according to claim 1, wherein the binder resin (i) has an acid value of 1–60 mgKOH/g.

16. The toner according to claim 1, wherein the toner exhibits viscoelastic properties inclusive of a dynamic modulus at 80° C. ($G'_{80}$) of $5\times10^4$–$1\times10^9$ N/m$^2$, dynamic moduli over a temperature range of 120–180° C. ($G'_{120-180}$) in a range of $1\times10^2$–$1\times10^5$ N/m$^2$, and a loss tangent characteristic satisfying:

$1<\tan\delta_{180}/\tan\delta_{min}$, wherein, $\tan\delta_{180}$ represents a loss tangent $\tan\delta$ (=G"/G', wherein G"/G' is a ratio between a loss modulus G" and a dynamic modulus G') at 180° C. and $\tan\delta_{min}$ represents a minimum of loss tangent $\tan\delta$ in a temperature range of 120–180° C.

17. The toner according to claim 1, wherein the toner has been obtained through a process comprising: melt-kneading the materials (i) to (v) at a measured melt-kneading temperature of at least 80° C. to provide a melt-kneaded product, followed by cooling for solidification, pulverization, and classification, of the melt-kneaded product.

18. The toner according to claim 1, wherein the toner contains 5–120 wt. parts of a magnetic material per 100 wt. parts of the binder resin so as to function as a magnetic mono-component developer.

19. The toner according to claim 1, wherein the toner contains 0.1–5 wt. parts of a magnetic material per 100 wt. parts of the binder resin so as to function as a substantially non-magnetic mono-component developer.

20. The toner according to claim 1, wherein the toner contains 0.1–5 wt. parts of a magnetic material per 100 wt.

parts of the binder resin, and is blended with magnetic carrier particles to provide a two-component developer.

21. The toner according to claim 1, wherein the toner has a ratio Mw/Mn of 100–3000.

22. A heat-fixing method, comprising: causing a fixing member to contact a toner image formed on a recording material, and imparting heat and pressure onto the toner image, thereby fixing the toner image onto the recording material, wherein the toner image is fixed onto a fixing surface of the recording material under application of silicone oil supplied from the fixing member to the fixing surface at a ratio of $0–1\times10^{-7}$ g/cm$^2$, and the toner image is formed of a toner comprising:

(i) a binder resin, (ii) a colorant, (iii) a hydrocarbon wax, (iv) a resin composition comprising at least a copolymer unit synthesized by reaction of a styrenic monomer with at least one monomer selected from the group consisting of nitrogen-containing vinyl monomers, carboxyl group-containing monomers, hydroxyl group-containing monomers, acrylate ester monomers and methacrylate ester monomers, and a hydrocarbon unit; and (v) an organometallic compound;

wherein the binder resin (i) comprises a polyester component in a proportion of at least 60 wt. % of the binder resin (i), and the toner has a molecular weight distribution as measured by gel permeation chromatography (GPC) including a weight-average molecular weight (Mw) of at least $4.0\times10^4$ and a ratio Mw/Mn of at least 50 between the weight-average molecular weight (Mw) and a number-average molecular weight (Mn).

23. A heat-fixing method comprising:

causing a fixing member to contact a toner image formed on a recording material;

and imparting heat and pressure onto the toner image, thereby fixing the toner image onto the recording material, wherein the toner image is fixed onto a fixing surface of the recording material under application of silicone oil supplied from the fixing member to the fixing surface at a ratio of $0–1\times10^{-7}$ g/cm$^3$, and the toner image is formed of a toner according to any one of claims 2–21.

* * * * *